United States Patent [19]

Kayanuma et al.

[11] Patent Number: 4,809,501

[45] Date of Patent: Mar. 7, 1989

[54] DOUBLE AIR-FUEL RATIO SENSOR SYSTEM HAVING IMPROVED EXHAUST EMISSION CHARACTERISTICS

[75] Inventors: Nobuaki Kayanuma, Gotenba, Japan; Toshinari Nagai, Ann Arbor, Mich.

[73] Assignee: Toyota Jidosha Kabushiki Kaisha, Aichi, Japan

[21] Appl. No.: 144,221

[22] Filed: Jan. 15, 1988

[30] Foreign Application Priority Data

Jan. 16, 1987 [JP] Japan ..... 62-6051
Jan. 16, 1987 [JP] Japan ..... 62-6052

[51] Int. Cl.[4] ..... F02D 41/14

[52] U.S. Cl. ..... 60/274; 60/276; 60/285; 123/489

[58] Field of Search ..... 123/440, 489, 589; 60/274, 276, 285; 364/431.05

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,130,095 | 12/1978 | Bowler et al. | 123/440 |
| 4,235,204 | 11/1980 | Rice | 123/440 |
| 4,475,517 | 10/1984 | Kobayashi et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |

FOREIGN PATENT DOCUMENTS

| | | |
|---|---|---|
| 52-102934 | 8/1977 | Japan . |
| 53-103796 | 9/1978 | Japan . |
| 55-37562 | 3/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-53661 | 3/1983 | Japan . |
| 58-48755 | 3/1983 | Japan . |
| 58-48756 | 3/1983 | Japan . |
| 58-72646 | 4/1983 | Japan . |
| 58-72647 | 4/1983 | Japan . |
| 58-135343 | 8/1983 | Japan . |
| 58-152147 | 9/1983 | Japan . |
| 58-150038 | 9/1983 | Japan . |
| 58-150039 | 9/1983 | Japan . |
| 59-32644 | 2/1984 | Japan . |
| 59-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |

*Primary Examiner*—Andrew M. Dolinar
*Attorney, Agent, or Firm*—Parkhurst, Oliff & Berridge

[57] ABSTRACT

In a double air-fuel sensor system including two air-fuel ratio sensors upstream and downstream of a catalyst converter provided in an exhaust gas passage, an air-fuel ratio correction amount is calculated in accordance with the results of the comparison of the outputs of the upstream-side and downstream-side air-fuel ratio sensors with first and second reference voltages, respectively, thereby obtaining an actual air-fuel ratio. The second reference voltage is changed in accordance with the load of the engine, to change the mean air-fuel ratio.

20 Claims, 27 Drawing Sheets

| Fig. 3 A | Fig. 3 B | Fig. 3C |
|---|---|---|

LEAN
RICH
A/F
TDR
CDLY 0
t1
t2
t3
t4
t5
t6
t7
t8
TDL
A/F'
(F1)

TDR
(-TDL)
LEAN
RICH
TDR

RSL
KIR
FAF1
RSR
KIL

| Fig. 5A | Fig. 5B | Fig. 5C | Fig. 5D |
|---|---|---|---|

V
1
0
RICH
LEAN
TDR
TDL
KIR
RSL
RSR
KIL
t1
t2
V2
VR2
F2
LEAN
RICH
KI2
RS2
RS2
KI2

V
1
0
RICH
LEAN
TDR
TDL
KIR
RSL
RSR
KIL
t1
t2
V2
t3
F2
MAX
MIN

| Fig.15A | Fig.15B | Fig.15C |
|---|---|---|

DOUBLE AIR-FUEL RATIO SENSOR SYSTEM HAVING IMPROVED EXHAUST EMISSION CHARACTERISTICS

BACKGROUND OF THE INVENTION (1) Field of the Invention

The present invention relates to a method and apparatus for feedback control of an air-fuel ratio in an internal combustion engine having two air-fuel ratio sensors upstream and downstream of a catalyst converter disposed within an exhaust gas passage.

(2) Description of the Related Art

Generally, in a feedback control of the air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio.

According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_X$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

To compensate for the fluctuation of the controlled air-fuel ratio, double $O_2$ sensor systems have been suggested (see: U.S. Pat. Nos. 3,939,654, 4,027,477, 4,130,095, 4,235,204). In a double $O_2$ sensor system, another $O_2$ sensor is provided downstream of the catalyst converter, and thus an air-fuel ratio control operation is carried out by the downstream-side $O_2$ sensor is addition to an air-fuel ratio control operation carried out by the upstream-side $O_2$ sensor. In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream side $O_2$ sensor.

(3) On the downstream side of the catalyst converter, the exhaust gas is mixed so that the concentration of oxygen in the exhaust gas is approximately in an equilibrium state.

Therefore, according to the double $O_2$ sensor system, the fluctuation of the output of the upstream-side $O_2$ sensor is compensated for by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, however, a stoichiometric air-fuel ratio ($\lambda=1$) is detected by the downstream-side $O_2$ sensor to implement an air-fuel ratio feedback control operation by the downstream-side $O_2$ sensor, and therefore, the mean value of the controlled air-fuel ratio is always located near the stoichiometric air-fuel ratio. As a result, it may be impossible to obtain an optimum air-fuel ratio at which a reduction of exhaust emissions, and a reduction of the smell of exhaust gas through catalysts can be obtained.

For example, in a high speed and high load region, the $NO_X$ emissions are increased, and thus the controlled air-fuel ratio must be on the rich side. On the other hand, in a low speed and low load region, the HC and CO emissions are increased and the smell of the exhaust gas is increased, and thus the controlled air-fuel ratio must be on the lean side.

SUMMARY OF THE INVENTION

It is an object of the present invention to provide a double air-fuel ratio sensor system in which an optimum air-fuel ratio for each driving region can be obtained.

According to the present invention, in a double air-fuel sensor system including two air-fuel ratio sensors upstream and downstream of a catalyst converter provided in an exhaust gas passage, an air-fuel ratio correction amount is calculated in accordance with the results of a comparison of the outputs of the upstream-side and downstream-side air-fuel ratio sensors with first and second reference voltages, respectively, thereby obtaining an actual air-fuel ratio. The second reference voltage is changed in accordance with the load of the engine. The second reference voltage exhibits the mean air-fuel ratio, and thus the air-fuel ratio is changed in accordance with the load of the engine.

BRIEF DESCRIPTION OF THE DRAWINGS

The present invention will be more clearly understood from the description as set forth below with reference to the accompanying drawings, wherein:

FIGS. 3, 3A-3C, 5, 5A-5D, 8, 10, 11, 12, 12A-12C, 13, 15, 15A-15C, 20, and 21 are flow charts showing the operation of the control circuit of FIG. 2;

DESCRIPTION OF THE PREFERRED EMBODIMENTS

Figure 1:
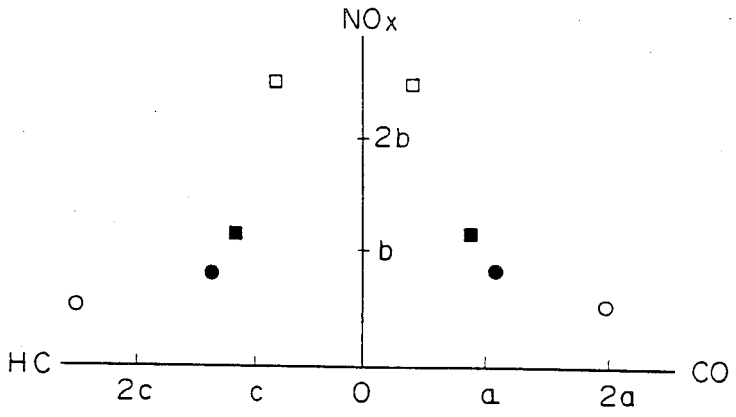
FIG. 1 is a graph showing the emission characteristics of a single $O_2$ sensor system and a double $O_2$ sensor system.
Figure 2:
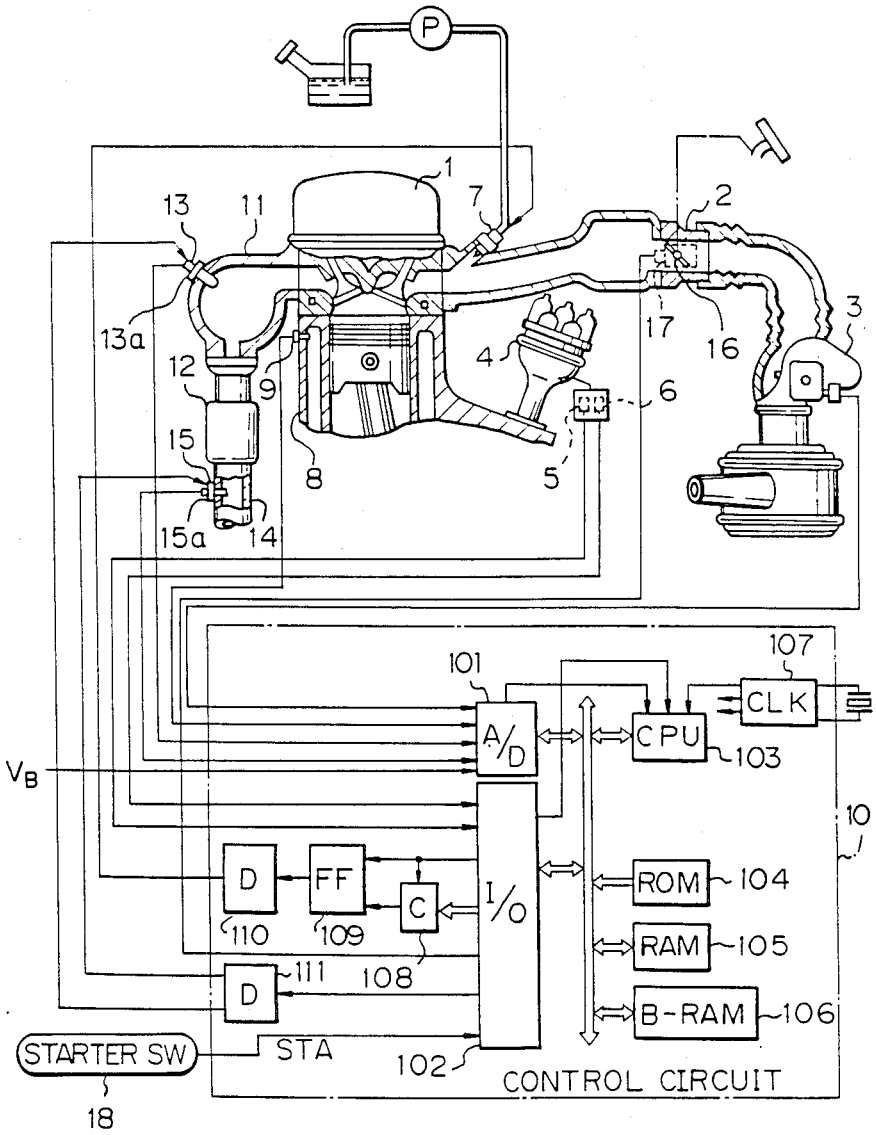
FIG. 2 is a schematic view of an internal combustion engine according to the present invention.

In FIG. 2, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air drawn into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1.

In this case, the crank-angle sensor 5 generates a pulse signal at every 720° crank angle (CA) while the crank-angle sensor 6 generates a pulse signal at every 30° CA. The pulse signals of the crank angle sensors 5 and 6 are supplied to an input/output (I/O) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, but are not shown in FIG. 4.

Disposed in a cylinder block 8 of the engine 1 is a coolant temperature sensor 9 for detecting the temperature of the coolant. The coolant temperature sensor 9 generates an analog voltage signal in response to the temperature THW of the coolant and transmits that signal to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_X$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit those signals to the A/D converter 101 of the control circuit 10.

Also, the $O_2$ sensors 13 and 15 incorporate heaters 13*a* and 15*a*, respectively, for heating the $O_2$ sensors 13 and 15 at a sensor element temperature higher than about 350° C. to 400° C., to activate the $O_2$ sensors 13 and 15.

Reference 16 designates a throttle valve, and 17 an idle switch for detecting whether or not the throttle valve 16 is completely closed.

Also, reference numeral 18 designates a starter switch, the output of which is supplied to an input/output interface 102 of the control circuit 10.

The control circuit 10, which may be constructed by a microcomputer, further comprises a central processing unit (CPU) 103, a read-only memory (ROM) 104 for storing a main routine, interrupt routines such as a fuel injection routine, an ignition timing routine, tables (maps), constants, etc., a random access memory 105 (RAM) for storing temporary data, a backup RAM 106, an interface 102 of the control circuit 10.

The control circuit 10, which may be constructed by a microcomputer, further comprises a central processing unit (CPU) 103, a read-only memory (ROM) 104 for storing a main routine and interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is not erased even when the ignition switch (not shown) is turned OFF.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal of the down counter 108, to reset the flip-flop 109, so that the driver circuit 110 stops the activation of the fuel injection valve 7. Thus, the amount of fuel corresponding to the fuel injection amount TAU is injected into the fuel injection valve 7.

Also, a driver circuit 111 to which the battery voltage $V_B$ is applied is used for simultaneously driving the heaters 13*a* and 15*a* of the $O_2$ sensors 13 and 15.

Interruptions occur at the CPU 103 when the A/D converter 101 completes an A/D conversion and generates an interrupt signal; when the crank angle sensor 6 generates a pulse signal; and when the clock generator 107 generates a special clock signal.

The intake air amount data Q of the airflow meter 3 and the coolant temperature data THW of the coolant sensor 9 are fetched by an A/D conversion routine(s)

executed at every predetermined time period and are then stored in the RAM 105. That is, the data Q and THW in the RAM 105 are renewed at every predetermined time period. The engine speed Ne is calculated by an interrupt routine executed at 30° CA, i.e., at every pulse signal of the crank angle sensor 6, and is then stored in the RAM 105.

The operation of the control circuit 10 of FIG. 2 will be now explained.

Figures 3, 3A:
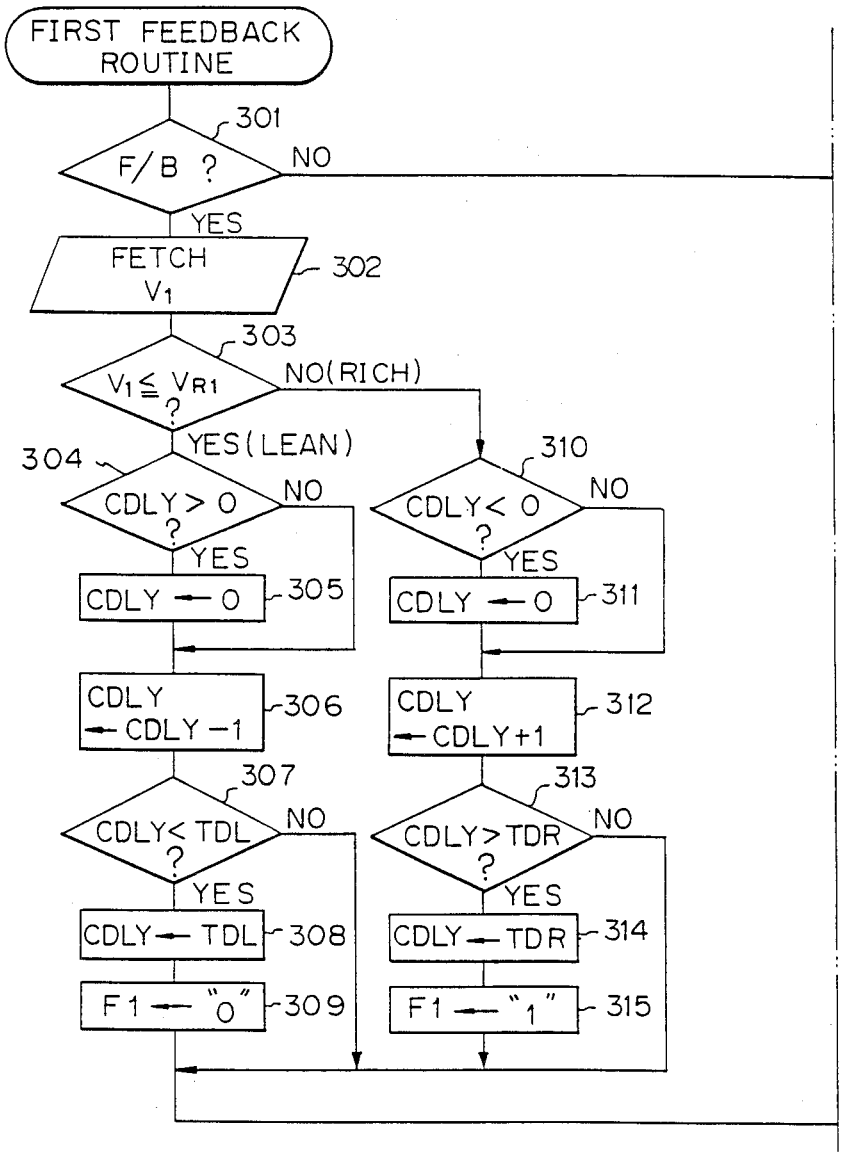
Figure 3B:
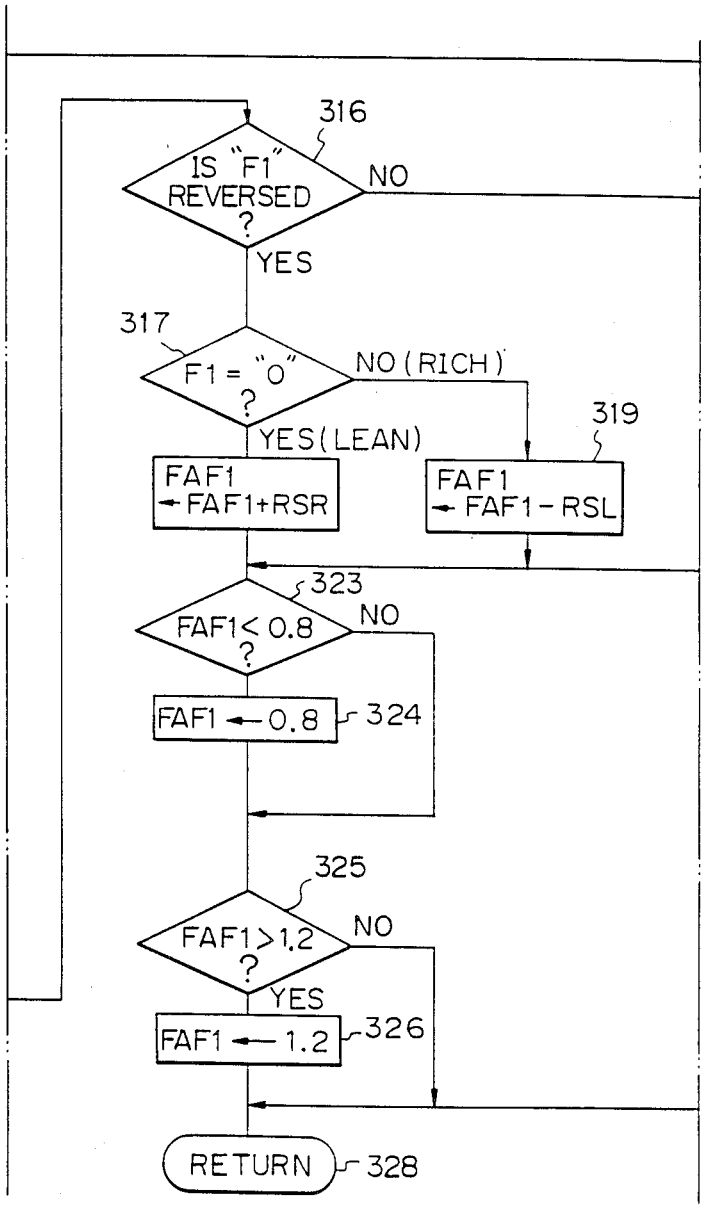
Figure 3C:
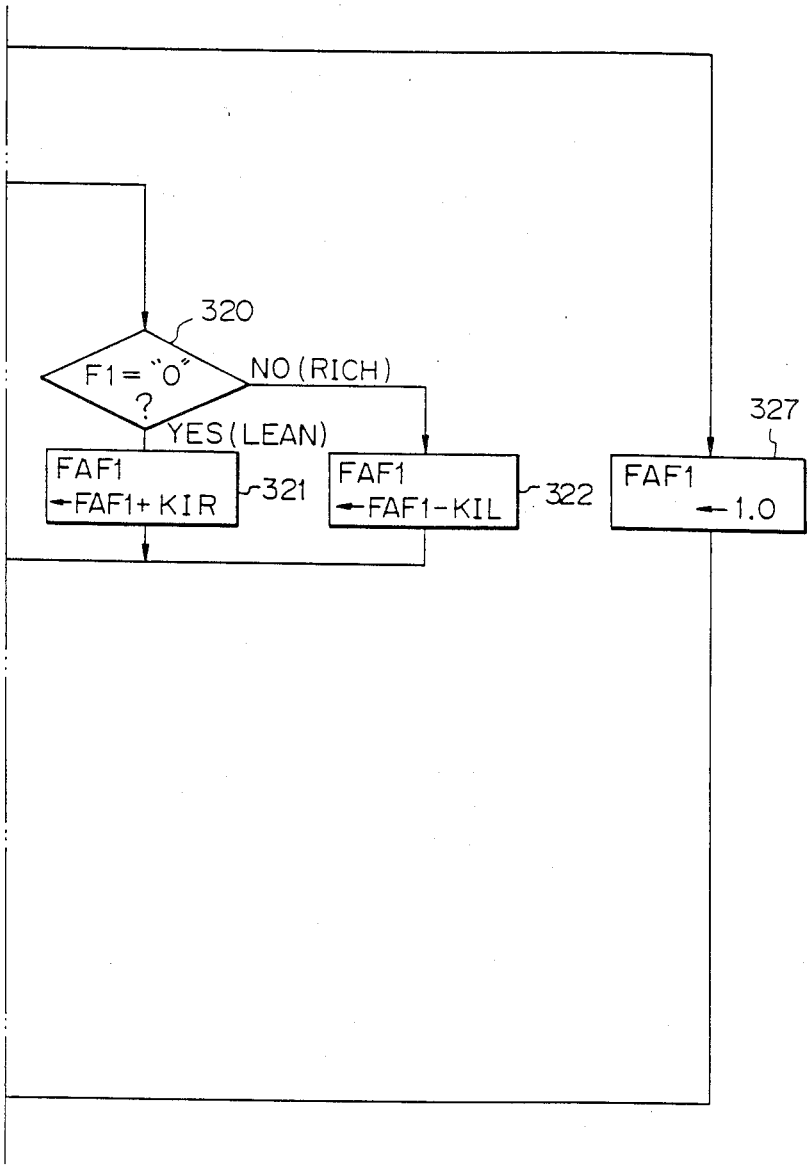

FIG. 3 is a routine for calculating a first air-fuel ratio feedback correction amount FAF1 in accordance with output of the upstream-side $O_2$ sensor 13 executed at every predetermined time period such as 4 ms.

At step 301, it is determined whether or not all of the feedback control (closed-loop control) conditions by the upstream-side $O_2$ sensor 13 are satisfied. The feedback control conditions are as follows:

(i) the engine is not in a starting state;

(ii) the coolant temperature THW is higher than 50° C.;

(iii) the power fuel incremental amount FPOWER is 0; and (iv) the upstream-side $O_2$ sensor 13 is in an activated state.

Note that the determination of activation/nonactivation of the upstream-side $O_2$ sensor 13 is carried out by determining whether or not the coolant temperature THW $\geqq$70° C., or by whether or not the output of the upstream-side $O_2$ sensor 13 is once swung, i.e., once changed from the rich side to the lean side, or vice versa. Of course, other feedback control conditions are introduced as occasion demands. However, an explanation of such other feedback control conditions is omitted.

If one or more of the feedback control conditions is not satisfied, the control proceeds to step 327, in which the amount FAF1 is caused to be 1.0 (FAF1=1.0), thereby carrying out an open-loop control operation. Note that, in this case, the amount FAF1 can be a value or a mean value immediately before the open-loop control operation. That is, the amount FAF1 or a mean value $\overline{FAF1}$ thereof is stored in the backup RAM 106, and in an open-loop control operation, the value FAF1 or $\overline{FAF1}$ is read out of the backup RAM 106.

Contrary to the above, at step 301, if all of the feedback control conditions are satisfied, the control proceeds the step 302.

At step 302, an A/D conversion is performed upon the output voltage $V_1$ of the upstream-side $O_2$ sensor 13, and the A/D converted value thereof is then fetched from the A/D converter 101. Then at step 303, the voltage $V_1$ is compared with a reference voltage $V_{R1}$ such as 0.45V, thereby determining whether the current air-fuel ratio detected by the upstream-side $O_2$ sensor 13 is on the rich side or on the lean side with respect to the stoichiometric air-fuel ratio.

If $V_1 \leqq V_{R1}$, which means that the current air-fuel ratio is lean, the control proceeds to step 304, which determines whether or not the value of a delay counter CDLY is positive. If CDLY>0, the control proceeds to step 305, which clears the delay counter CDLY, and then proceeds to step 306. If CDLY'0, the control proceeds directly to step 306. At step 306, the delay counter CDLY is counted down by 1, and at step 307, it is determined whether or not CDLY>TDL. Note that TDL is a lean delay time period for which a rich state is maintained even after the output of the upstream-side $O_2$ sensor 13 is changed from the rich side to the lean side, and is defined by a negative value. Therefore, at step 307, only when CDLY<TDL does the control proceed to step 308, which causes CDLY to be equal to TDL, and then to step 309, which causes a first air-fuel ratio flag F1 to be "0" (lean state). On the other hand, if $V_1 > V_{R1}$, which means that the current air-fuel ratio is rich, the control proceeds to step 310, which determines whether or not the value of the delay counter CDLY is negative. If CDLY<0, the control proceeds to step 311, which clears the delay counter CDLY, and then proceeds to step 312. If CDLY >0, the control directly proceeds to 312. At step 312, the delay counter CDLY is counted up by 1, and at step 313, it is determined whether or not CDLY>TDR. Note that TDR is a rich delay time period for which a lean state is maintained even after the output of the upstream-side $O_2$ sensor 13 is changed from the lean side to the rich side, and is defined by a positive value. Therefore, at step 313, only when CDLY ° TDR does the control proceed to step 314, which causes CDLY to be equal to TDR, and then to step 315, which causes the first air-fuel ratio flag F1 to be "1" (rich state).

Next, at step 316, it is determined whether or not the first air-fuel ratio flag F1 is reversed, i.e., whether or not the delayed air-fuel ratio detected by the upstream-side $O_2$ sensor 13 is reversed. If the first air-fuel ratio flag F1 is reversed, the control proceeds to steps 317 to 319, which carry out a skip operation.

At step 317, if the flag F1 is "0" (lean) the control proceeds to step 318, which remarkably increases the correction amount FAF1 by a skip amount RSR. Also, if the flag F1 is "1" (rich) at step 317, the control proceeds to step 319, which remarkably decreases the correction amount FAF1 by a skip amount RSL.

On the other hand, if the first air-fuel ratio flag F1 is not reversed at step 316, the control proceeds to steps 320 to 322, which carries out an integration operation. That is, if the flag F1 is "0" (lean) at step 320, the control proceeds to step 321, which gradually increases the correction amount FAF1 by a rich integration amount KIR. Also, if the flag F1 is "1" (rich) at step 320, the control proceeds to step 322, which gradually decreases the correction amount FAF1 by a lean integration amount KIL.

The correction amount FAF1 is guarded by a minimum value 0.8 at steps 323 and 324. Also, the correction amount FAF1 is guarded by a maximum value 1.2 at steps 325 and 326. Thus, the controlled air-fuel ratio is prevented from becoming overlean or overrich.

The correction amount FAF1 is then stored in the RAM 105, thus completing this routine of FIG. 3 at steps 328.

Figures 4A, 4B, 4C, 4D:
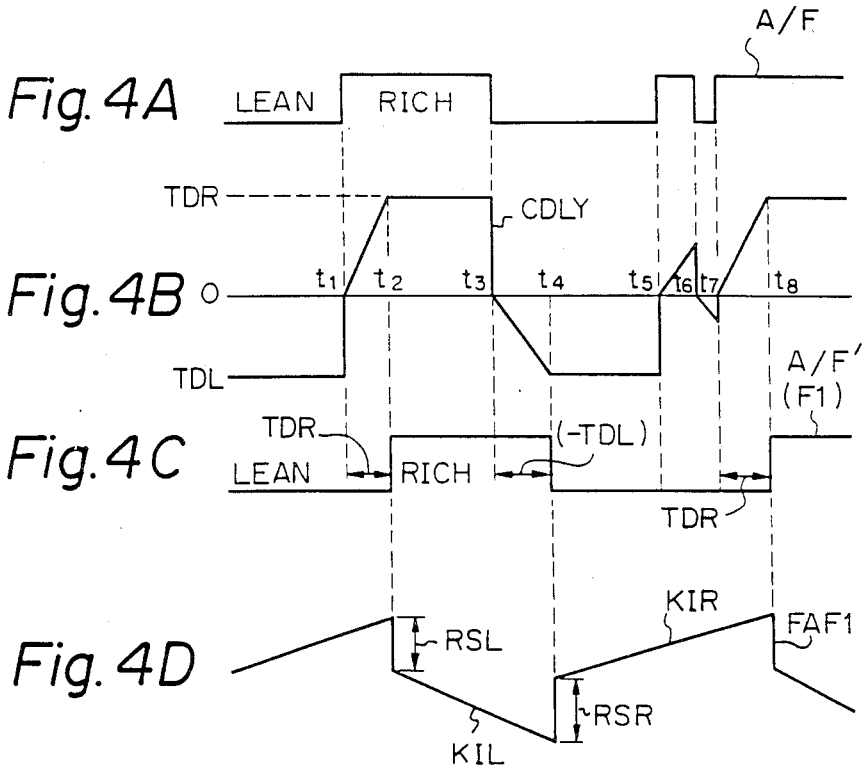
FIGS. 4A through 4D are timing diagrams explaining the flow chart of FIG. 3.

The operation by the flow chart of FIG. 3 will be further explained with reference to FIGS. 4A through 4D. As illustrated in FIG. 4A, when the air-fuel ratio A/F is obtained by the output of the upstream-side $O_2$ sensor 13, the delay counter CDLY is counted up during a rich state, and is counted down during a lean state, as illustrated in FIG. 4B. As a result, a delayed air-fuel ratio corresponding to the first air-fuel ratio flag F1 is obtained as illustrated in FIG. 4C. For example, at time $t_l$, even when the air-fuel ratio A/F is changed from the lean side to the rich side, the delayed air-fuel ratio A/F' (F1) is changed at time $t_2$ after the rich delay time period TDR. Similarly, at time $t_3$, even when the air-fuel ratio A/F is changed from the rich side to the lean side, the delayed air fuel ratio F1 is changed at time $t_4$ after the lean delay time period TDL. However, at time $t_5$, $t_6$, or $t_7$, when the air-fuel ratio A/F is reversed within a shorter time period than the rich delay time period TDR or the lean delay time period TDL, the delay air-fuel ratio A/F' is reversed at time $t_8$. That is, the delayed air-fuel ratio A/F' is stable when compared with the air-fuel ratio A/F. Further, as illustrated in FIG. 4D, at every change of the delayed air-fuel ratio A/F' from the rich side to the lean side, or vice versa, the correction amount FAF is skipped by the skip amount RSR or RSL, and in addition, the correction amount FAF1 is gradually increased or decreased in accordance with the delayed air-fuel ratio A/F'.

Air-fuel ratio feedback control operations by the downstream-side $O_2$ sensor 15 will be now explained. There are two types of air-fuel ratio feedback control operations by the downstream-side $O_2$ sensor 15, i.e., the operation type in which a second air-fuel ratio correction amount FAF2 is introduced therein, and the operation type in which an air-fuel ratio feedback control parameter in the air-fuel ratio feedback control operation by the upstream-side $O_2$ sensor 13 is variable. Further, as the air fuel ratio feedback control parameter, there are nominated a delay time period TD (in more detail, the rich delay time period TDR and the lean delay time period TDL), a skip amount RS (in more detail, the rich skip amount RSR and the lean skip amount RSL), an integration amount KI (in more detail, the rich integration amount KIR and the lean integration amount KIL), and the reference voltage $V_{R1}$.

For example, if the rich delay time period becomes longer than the lean delay time period (TDR>(−TDL)), the controlled air-fuel becomes richer, and if the lean delay time period becomes longer than the rich delay time period ((−TDL)>TDR), the controlled air-fuel ratio becomes leaner. Thus, the air-fuel ratio can be controlled by changing the rich delay time period TDR1 and the lean delay time period (−TDL) in accordance with the output of the downstream-side $O_2$ sensor 15. Also, if the rich skip amount RSR is increased or if the lean skip amount RSL is decreased, the controlled air-fuel ratio becomes richer, and if the lean skip amount RSL is increased or if the rich skip amount RSR is decreased, the controlled air-fuel ratio becomes leaner. Thus, the air-fuel ratio can be controlled by changing the rich skip amount RSR and the lean skip amount RSL in accordance with the output downstream-side $O_2$ sensor Further, if the rich integration amount KIR is increased or if the lean integration amount KIL is decreased, the controlled air-fuel ratio becomes richer, and if the lean integration amount KIL is increased or if the rich integration amount KIR is decreased, the controlled air-fuel ratio becomes leaner. Thus, the air-fuel ratio can be controlled by changing the rich integration amount KIR and the lean integration amount KIL in accordance with the output of the downstream-side $O_2$ sensor 15. Still further, if the reference voltage VR1 is increased, the controlled air-fuel ratio becomes richer, and if the reference voltage $V_{R1}$ is decreased, the controlled air-fuel ratio becomes leaner. Thus, the air-fuel ratio can be controlled by changing the reference voltage $V_{R1}$ in accordance with the output of the downstream-side $O_2$ sensor 15.

There are various merits in the control of the air-fuel ratio feedback control parameters by the output $V_2$ of the downstream-side $O_2$ sensor 15. For example, when the delay time periods TDR and TDL are controlled by the output $V_2$ of the downstream-side $O_2$ sensor 15, it is possible to precisely control the air-fuel ratio. Also, when the skip amounts RSR and RSL are controlled by the output $V_2$ of the downstream-side $O_2$ sensor 15, it is possible to improve the response speed of the air-fuel ratio feedback control by the output $V_2$ of the downstream-side $O_2$ sensor 15. Of course, it is possible to simultaneously control two or more kinds of the air-fuel ratio feedback control parameters by the output $V_2$ of the downstream-side $O_2$ sensor 15.

A double $O_2$ sensor system into which a second air-fuel ratio correction amount FAF2 is introduced will be explained with reference to FIGS. 5 and 8.

Figures 5, 5A:
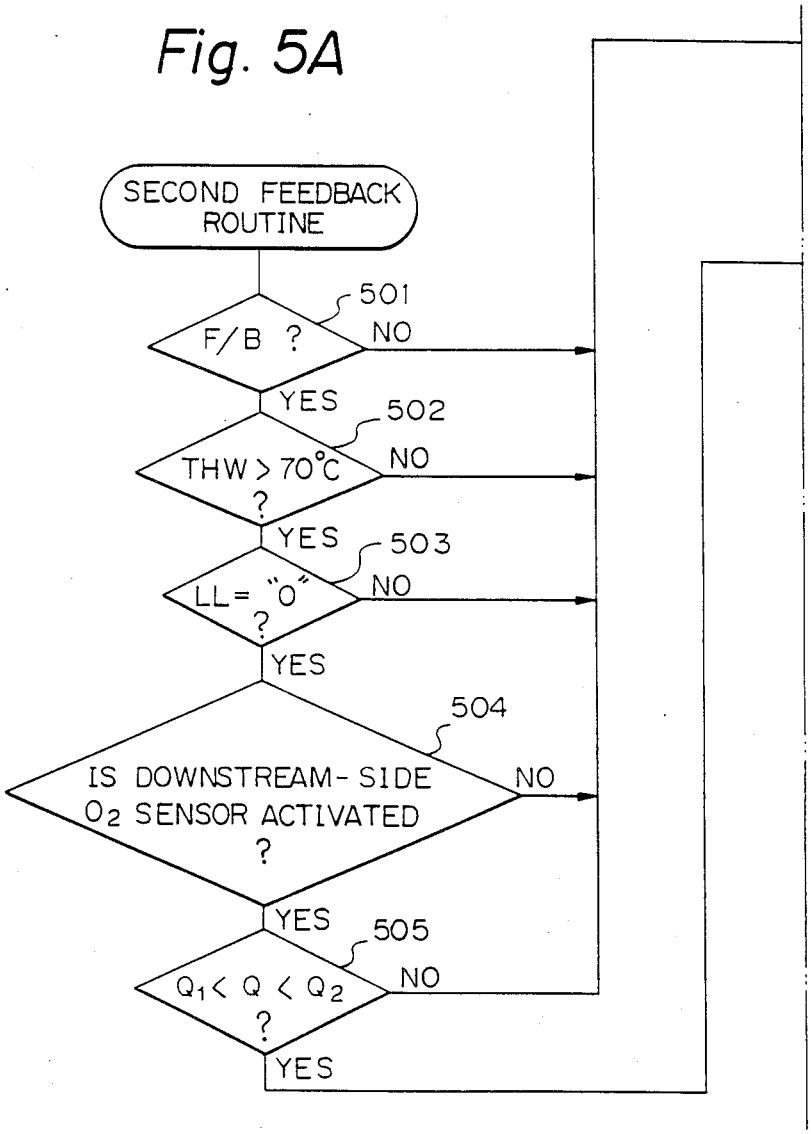
Figure 5B:
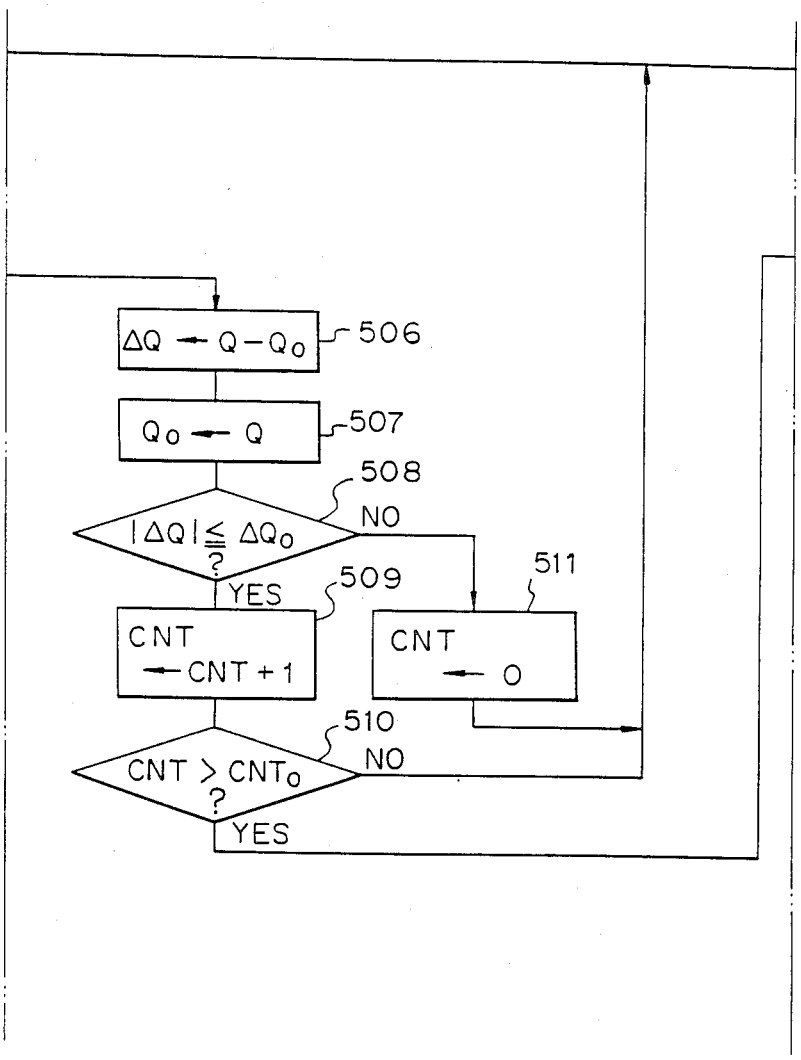
Figure 5C:
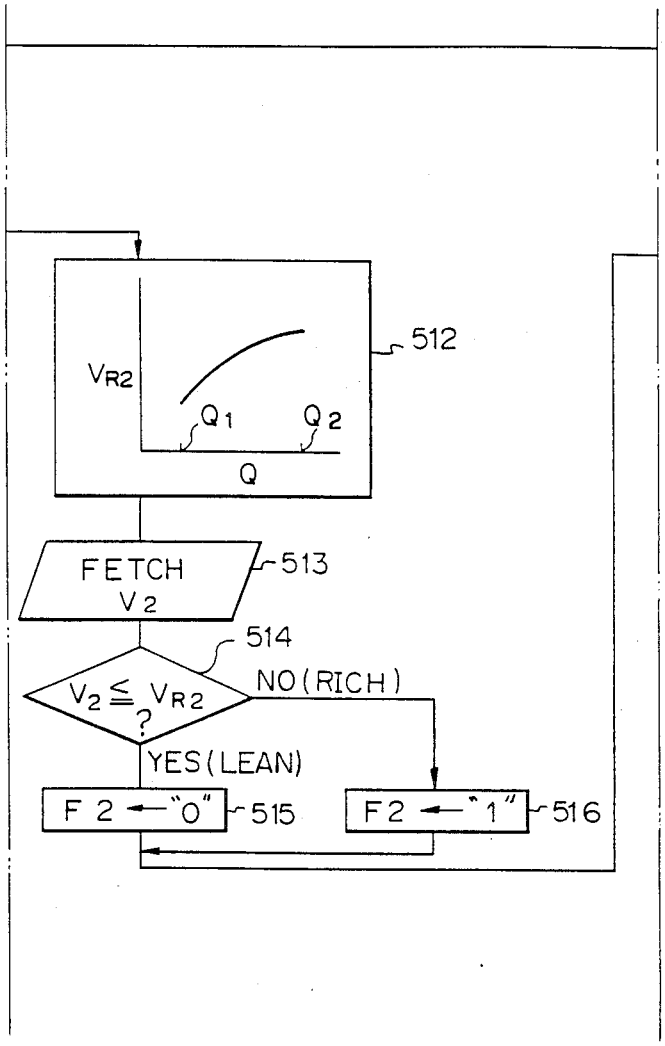
Figure 5D:
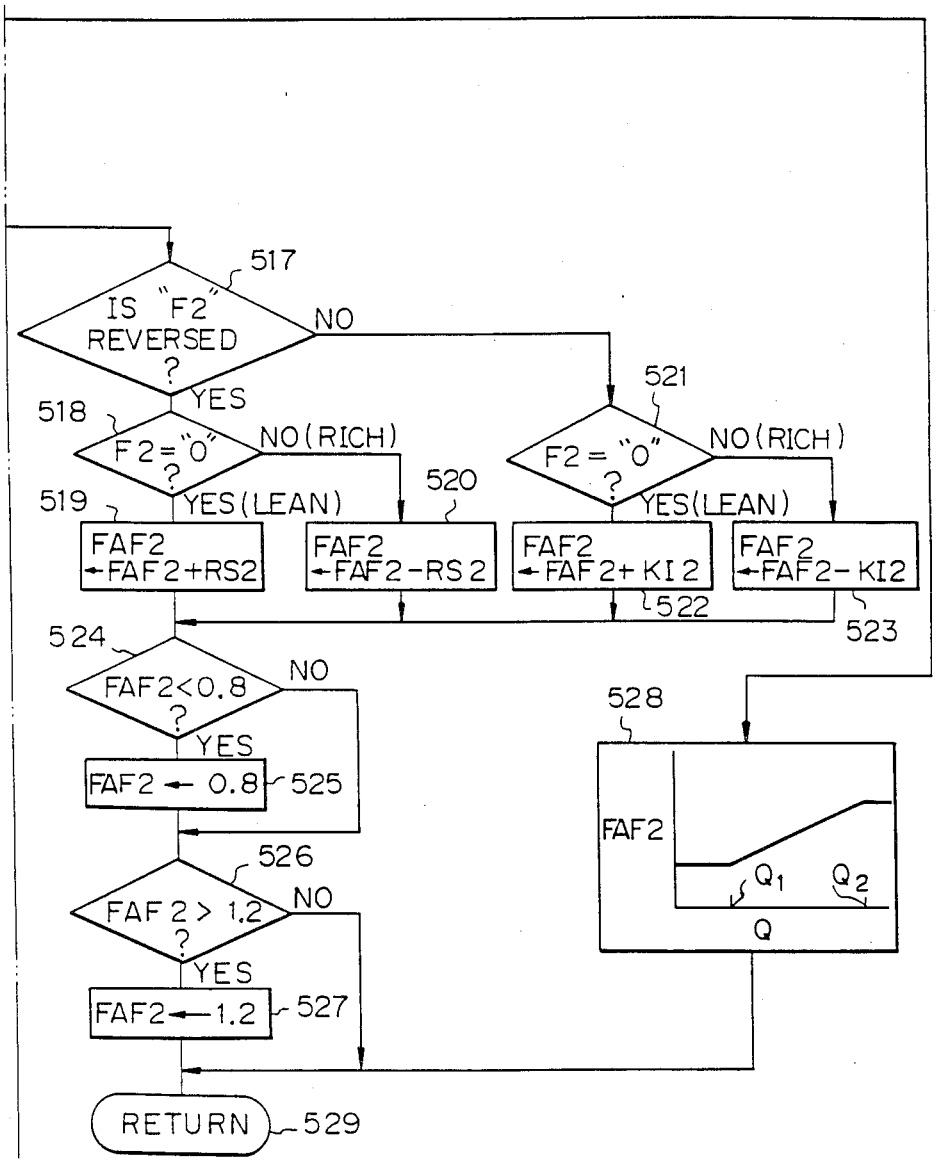

FIG. 5 is a routine for calculating a second air-fuel ratio feedback correction amount FAF2 in accordance with the output of the downstream-side $O_2$ sensor 15 executed at every predetermined time period such as 1 s.

At steps 501 through 505, it is determined whether or not all of the feedback control (closed-loop control) conditions by the downstream-side $O_2$ sensor 15 are satisfied. For example, at step 501, it is determined whether or not the feedback control conditions by the upstream-side $O_2$ sensor 13 are satisfied. At step 502, it is determined whether or not the coolant temperature THW is higher than 70° C. At step 503, it is determined whether or not the throttle valve 16 is open (LL="0"). At step 504, it is determined whether or not the output of the downstream-side $O_2$ sensor 15 has been once changed from the lean side to the rich side or vice versa. At step 505, it is determined whether or not the intake air amount Q is within a predetermined range from $Q_1$ to $Q_2$. Of course, other feedback control conditions are introduced as occasion demands. However, an explanation of such other feedback control conditions is omitted.

If one or more of the feedback control conditions is not satisfied, the control proceeds directly to step 528, thereby carrying out an open-loop control operation. That is, at step 528, the second air-fuel ratio correction amount FAF2 is calculated from a one-dimensional map stored in the ROM 104 by using the intake air amount Q. Note that, in this case, the amount FAF2 can be made a definite value such as 1.0. Also, the amount FAF2 or a mean value FAF2 thereof is stored in the backup RAM 106, and in an open-loop control operation, the value FAF2 or $\overline{FAF2}$ can be read out of the backup RAM 106.

Contrary to the above, if all of the feedback control conditions are satisfied, the control proceeds to step 506.

At step 506, the intake air amount Q is read out of the RAM 105, and the change ΔQ thereof is calculated by $$\Delta Q \leftarrow Q - Q_0$$

where $Q_0$ is a value of the intake air amount Q executed at a previous execution. Then, at step 507, in order to prepare the next execution, the value $Q_0$ is replaced by Q. At step 508, it is determined whether or not the absolute value $|\Delta Q|$ of the change ΔQ is smaller than or equal to a predetermined value $\Delta Q_0$. As a result, if $\Delta Q| \leqq \Delta Q_0$, the control proceeds to steps 509 and 510, but if $|\Delta Q| > \Delta Q_0$, the control proceeds to step 511. As a result, only when a stable or steady state in which $|\Delta Q| \leqq \Delta Q_0$ is satisfied continues for a $CNT_0 \times 1$ s, does the control proceed to step 517. Otherwise, the control proceeds to step 528.

Figure 6:
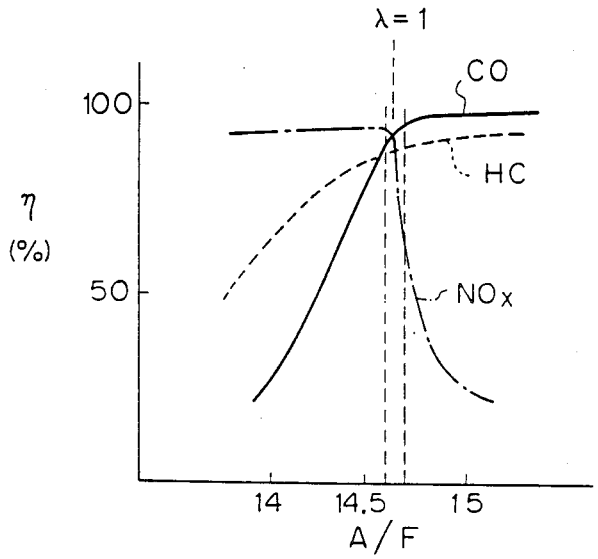
FIG. 6 is a graph showing the $O_2$ storage effect of three-way catalysts.

Note that the output $V_2$ of the downstream-side $O_2$ sensor 15 is delayed by the delay due to the transport of the exhaust gas and the $O_2$ storage effect of the three-way catalysts. As a result, the steady state determining steps 506 to 511 are provided. Referring to FIG. 6 showing the $O_2$ storage effect of the three-way catalysts, the ordinate $\sigma$ represents the catalytic cleaning rate, and the abscissa A/F represents the air-fuel ratio of the exhaust gas. That is, when the air-fuel ratio is on the rich side with respect to the stoichiometric air-fuel ratio ($\lambda=1$), the cleaning rate $\eta$ of the $NO_X$ emission is increased, but when the air-fuel ratio is on the lean side with respect to the stoichiometric air-fuel ratio, the cleaning rate of the HC and CO emissions is increased. However, due to the $O_2$ storage effect, when the air-fuel ratio is lean these catalysts absorb oxygen, and when the air-fuel ratio is rich they absorb and react HC and CO with the already absorbed oxygen.

As explained above, when the change $\Delta Q$ of the intake air amount Q is stable, the control proceeds to step 512, which calculates a second reference voltage from a one-dimensional map stored in the ROM 104 by using the intake air amount Q. Here, when the intake air amount Q is large, the reference voltage $V_{R2}$ is large, and when the intake air amount Q is small, the reference voltage $V_{R2}$ is small. Therefore, as can be seen from the output characteristics of the downstreamside $O_2$ sensor 15 shown in FIG. 7, when the intake air amount Q is large, the reference voltage $V_{R2}$ is placed on the rich side, and when the intake air amount Q is small, the reference voltage $V_{R2}$ is placed on the lean side. Note that, when the intake air amount Q is smaller than the value $Q_1$ such as 25 $m^3/h$, the temperature of the element of the downstream-side $O_2$ sensor 15 is too low, and when the intake air amount Q is larger than the value $Q_2$ such as 120 $m^3/h$, an over temperature incremental operation is carried out to prevent overheating of the catalyst converter 14. Accordingly, the condition: $Q_1 \leqq Q \leqq Q_2$ is set at step 510. Also, if $Q=Q_1$, the reference voltage $V_{R2}$ is, for example, about 0.2V to 0.4V, and if $Q=Q_2$, the reference voltage $V_{R2}$ is, for example, about 0.6V to 0.8V.

Also, other parameters such as the opening of the throttle valve 16, the intake air pressure PM, and the like can be used instead of the intake air amount Q. Further, the reference voltage $V_{R2}$ can be calculated from a two-dimensional map by using one of the load parameters and the engine speed Ne.

At step 513, an A/D conversion is performed upon the output voltage $V_2$ of the downstream-side $O_2$ sensor 15, and the A/D converted value thereof is then fetched from the A/D converter 101. Then, at step 514, the voltage $V_2$ is compared with a reference voltage $V_{R2}$ such as 0.55V, thereby determining whether the current air-fuel ratio detected by the downstream-side $O_2$ sensor 15 is on the rich side or on the lean side with respect to the stoichiometric air-fuel ratio. Note that the reference voltage $V_{R2}$ (=0.55V) is preferably higher than the reference voltage $V_{R1}$ (=0.45V), in consideration of the difference in output characteristics and deterioration speed between the $O_2$ sensor 13 upstream of the catalyst converter 12 and the $O_2$ sensor 15 downstream of the catalyst converter 12. However, the voltage $V_{R2}$ can be voluntarily determined.

At step 514, if the air-fuel ratio upstream of the catalyst converter 12 is lean, the control proceeds to step 515 which resets a second air-fuel ratio flag F2. Alternatively, the control proceeds to the step 516, which sets the second air-fuel ratio flag F2.

At step 517, it is determined whether or not the second air-fuel ratio flag F2 is reversed. If the second air-fuel ratio flag F2 is reversed, the control proceeds to steps 518 to 520 which carry out a skip operation. That is, if the fag F2 is "0" (lean) at step 518, the control proceeds to step 519, which remarkably increases the second correction amount FAF2 by a skip amount RS2. Also, if the flag F2 is "1" (rich) at step 518, the control proceeds to step 519, which remarkably decreases the second correction amount FAF2 by the skip amount RS2. On the other hand, if the second air-fuel ratio flag F2 is not reversed at step 517, the control proceeds to steps 521 to 523, which carry out an integration operation. That is, if the flag F2 is "0" (lean) at step 517, the control proceeds to step 522, which gradually increases the second correction amount FAF2 by an integration amount KI2. Also, if the flag F2 is "1" (rich) at step 523, the control proceeds to step 523, which gradually decreases the second correction amount FAF2 by the integration amount KI2.

Note that the skip amount RS2 is larger than the integration amount KI2.

The second correction amount FAF2 is guarded by a minimum value 0.8 at steps 524 and 525, and by a maximum value 1.2 at steps 526 and 527, thereby also preventing the controlled air-fuel ratio from becoming overrich or overlean.

Figure 7:
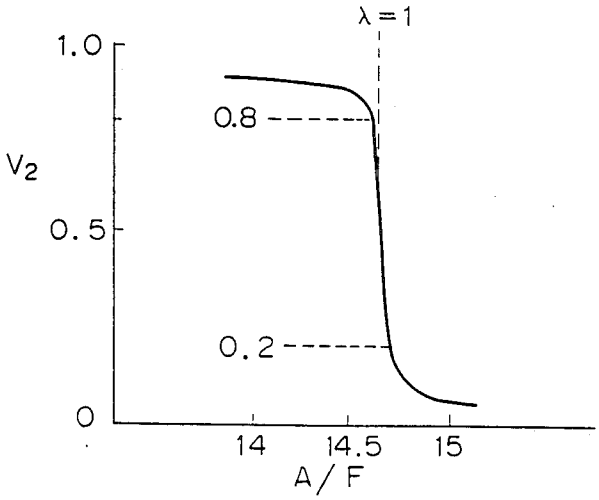
FIG. 7 is a graph showing the output characteristics of an $O_2$ sensor.

The correction amount FAF2 is then stored in the backup RAM 106, thus completing this routine of FIG. 7 at step 529.

Figure 8:
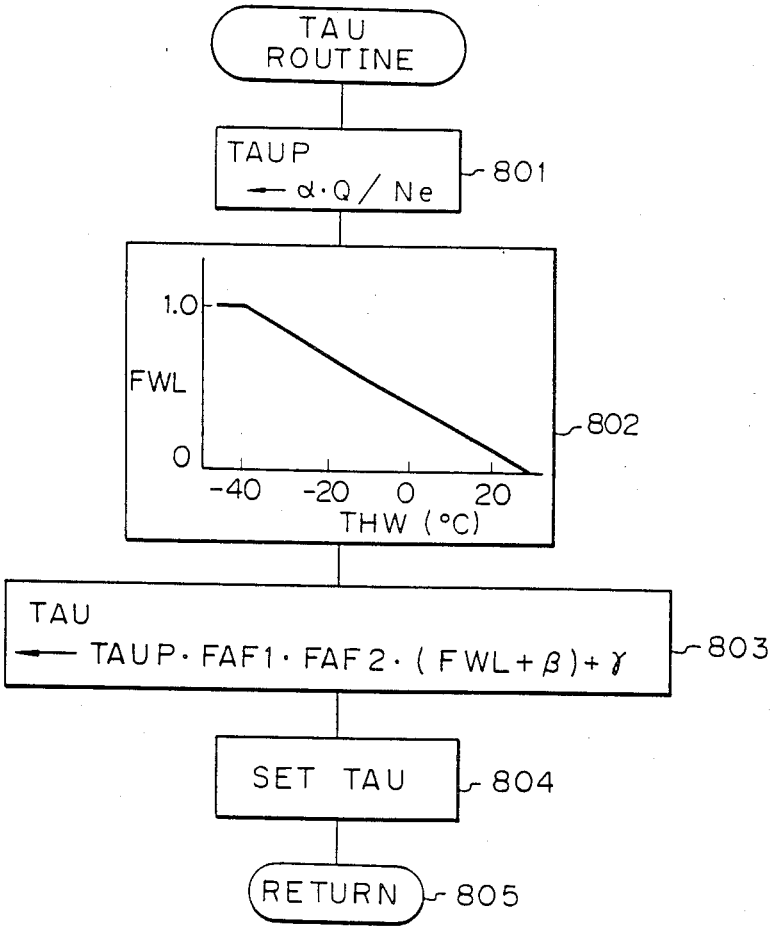

FIG. 8 is a routine for calculating a fuel injection amount TAU executed at every predetermined crank angle such as 360° CA. At step 801, a base fuel injection amount TAUP is calculated by using the intake air amount data Q and the engine speed data Ne stored in the RAM 105. That is, $$TAUP \leftarrow \alpha \cdot Q/Ne$$

where $\alpha$ is a constant. Then at step 802, a warming-up incremental amount FWL is calculated from a one-dimensional map stored in the ROM 104 by using the coolant temperature data THW stored in the RAM 105. Note that the warming-up incremental amount FWL decreases when the coolant temperature THW increases. At step 803, a final fuel injection amount TAU is calculated by $$TAU \leftarrow TAUP.FAF1.FAF2.(FWL+\beta)+\gamma$$

where $\beta$ and $\gamma$ are correction factors determined by other parameters such as the voltage of the battery and the temperature of the intake air. At step 804, the final fuel injection amount TAU is set in the down counter 107, and in addition, the flip-flop 108 is set to initiate the activation of the fuel injection valve 7. Then, this routine is completed by step 805. Note that, as explained above, when a time period corresponding to the amount TAU has passed, the flip-flop 109 is reset by the carry-out signal of the down counter 108 to stop the activation of the fuel injection valve 7.

Figures 9A, 9B, 9C, 9D, 9E, 9F, 9G:
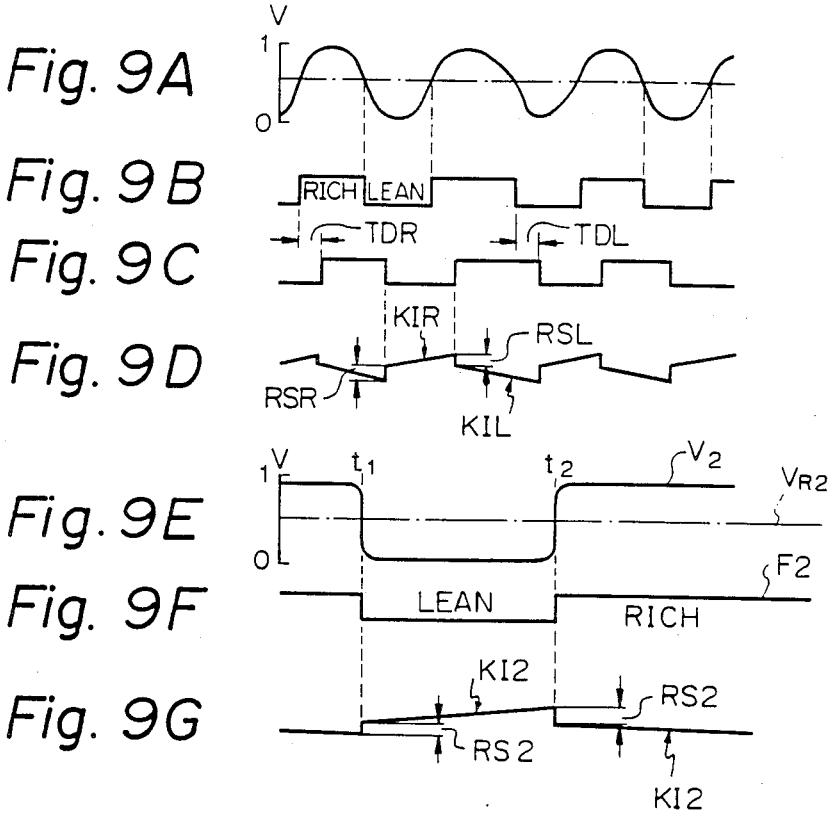
FIGS. 9A through 9G are timing diagrams explaining the flow charts of FIGS. 3, 5, and 8.

FIGS. 9A through 9G are timing diagrams for explaining the two air-fuel ratio correction amounts FAF1 and FAF2 obtained by the flow charts of FIGS. 3, 5, and 8. In this case, the engine is in a closed-loop control state for the two $O_2$ sensors 13 and 15. When the output of the upstream-side $O_2$ sensor 13 is changed as illustrated in FIG. 9A, the determination at step 303 of FIG. 3 is shown in FIG. 9B, and a delayed determination thereof corresponding to the first air-fuel ratio flag F1 is shown in FIG. 9C. As a result, as shown in FIG. 9D, every time the delayed determination is changed from the rich side to the lean side, or vice versa, the first air-fuel ratio correction amount FAF1 is skipped by the amount RSR or RSL. Otherwise, the first air-fuel ratio correction amount FAF1 is gradually changed by the amount KIR or KIL.

On the other hand, when the output of the downstream-side $O_2$ sensor 15 is changed as illustrated in FIG. 9E, the determination at 514 of FIG. 5 corresponding to the second air-fuel ratio flag F2 is shown in FIG. 9F. Therefore, as shown in FIG. 9G, every time the determination is changed from the rich side to the lean side, or vice versa, the second air-fuel ratio correction amount FAF2 is skipped by the skip amount RS2. Alternatively, the second air-fuel ratio correction amount FAF2 is gradually changed by the integration amount KI2.

Figure 10:
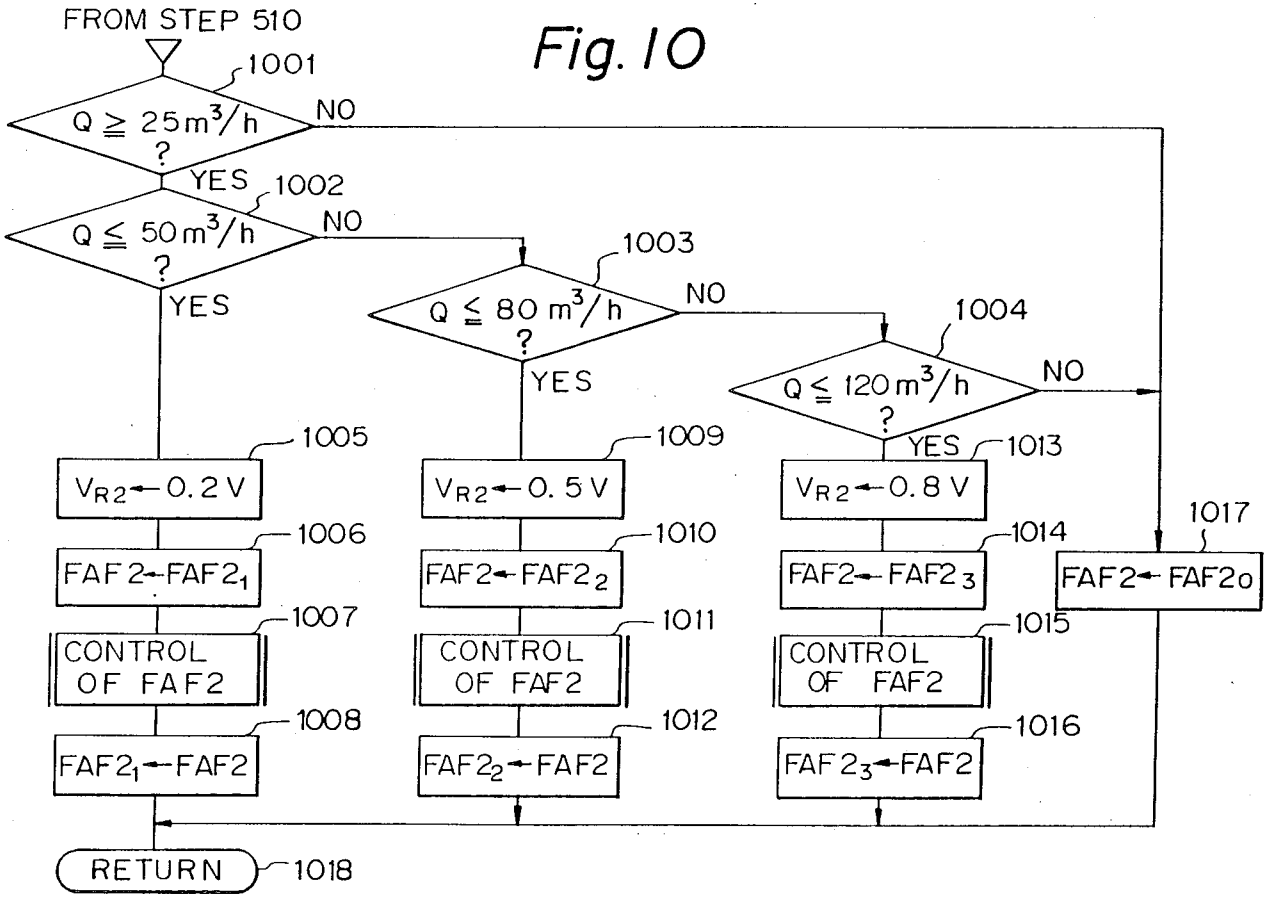

In FIG. 10, which is a modification of FIG. 5, steps 1001 through 1018 are used instead of steps 512 through 529. That is, the second air-fuel ratio correction FAF2 is divided into a plurality of regions using the load parameter Q as follows:

| | |
|---|---|
| $25\ m^3/h < Q \leqq 50\ m^3/h$ | $FAF2_1$ |
| $50\ m^3/h < Q \leqq 80\ m^3/h$ | $FAF2_2$ |
| $80\ m^3/h < Q \leqq 120\ m^3/h$ | $FAF2_3$ |

Also, the second reference voltage $V_{R2}$ is divided into a plurality of regions using the load parameter Q as follows:

| | |
|---|---|
| $25\ m^3/h < Q \leqq 50\ m^3/h$ | $V_{R2} = 0.2\ V$ |
| $50\ m^3/h < Q \leqq 80\ m^3/h$ | $V_{R2} = 0.5\ V$ |
| $80\ m^3/h < Q \leqq 120\ m^3/h$ | $V_{R2} = 0.8\ V$ |

Note that, in this case, the reference voltage $V_{R2}$ can be determined by step 512 of FIG. 5.

At steps 1001 to 1004, it is determined to what regions the intake air amount Q belongs. As a result, if $Q \leqq 25\ m^3/h$ or if $Q > 120\ m^3/h$, the control proceeds to step 1017 which carries out an open loop control operation. That is, the second air-fuel ratio correction amount FAF2 is made a definite value. Also, in this case, this amount FAF2 can be determined by step 528 of FIG. 5.

On the other hand, if the intake air amount Q is in a low region ($25\ m^3/h < Q > 50\ m^3/h$), the control proceeds to steps 1005 to 1008; if the intake air amount Q is in a medium region ($50\ m^3/h < Q < 80\ m^3/h$), the control proceeds to steps 1009 to 1012; and if the intake air amount Q is in a high region ($80\ m^3/h < Q \leqq 120\ m^3/h$), the control proceeds to steps 1013 to 1016.

Figure 11:
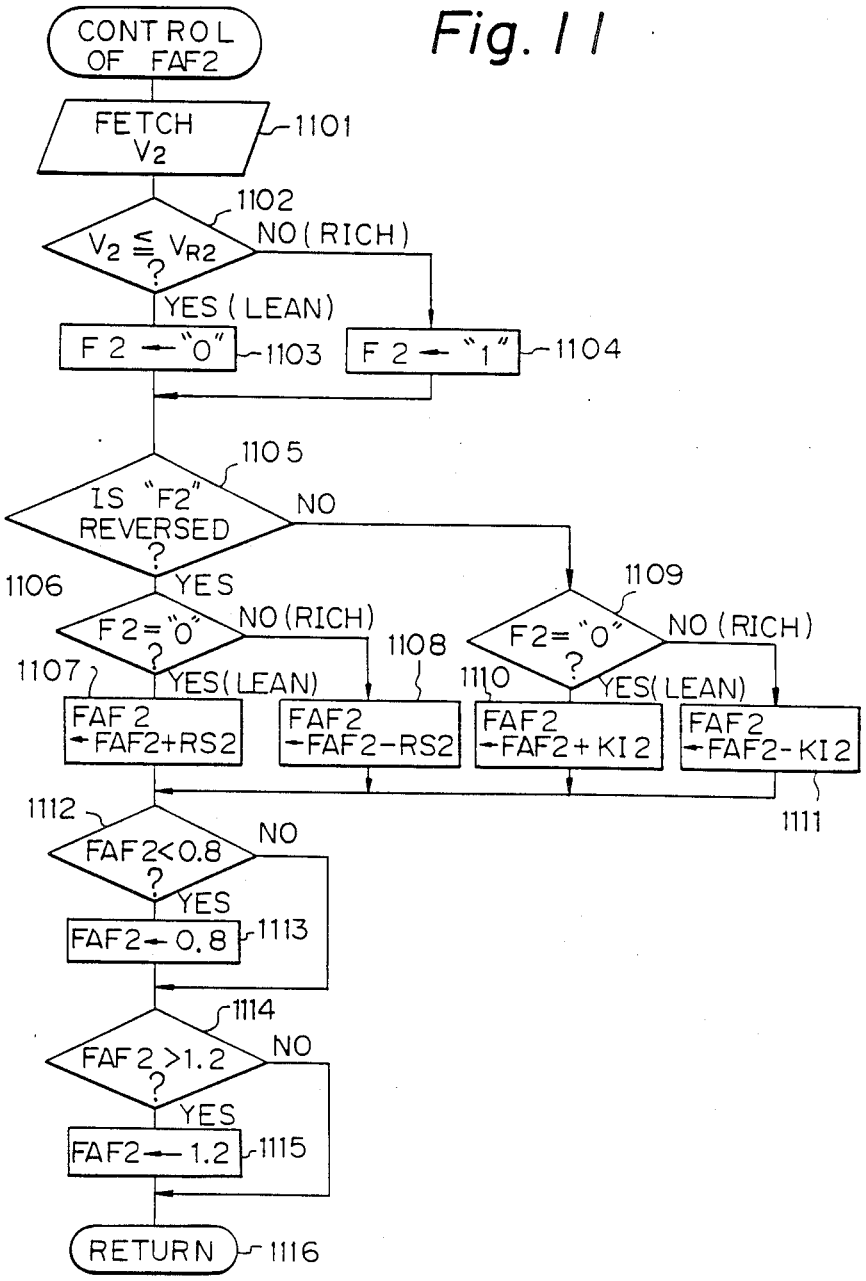

Steps 1005 to 1008 are now further explained. At step 1005, the reference voltage $V_{R2}$ is made 0.2V, which corresponds to a lean air-fuel ratio as illustrated in FIG. 7. At step 1006, the second air-fuel ratio correction amount FAF2 is made $FAF2_1$. Then, the second air-fuel ratio correction amount FAF2 is changed by step 1007. The details of step 1007 are illustrated in FIG. 11. That is, in FIG. 11, steps 1101 through 1115 correspond to steps 513 through 527, respectively, of FIG. 5. Therefore, the amount FAF2 is calculated so that the mean air-fuel ratio downstream of the catalyst converter 12 is a lean air-fuel ratio corresponding to the reference voltage $V_{R2}$ (=0.2V). Then, at step 1008, the amount $FAF2_1$ for the low region is made FAF2.

Steps 1009 to 1012 are now explained. At step 1009, the reference voltage $V_{R2}$ is made 0.5V, which corresponds to a stoichiometric air-fuel ratio as illustrated in FIG. 7. At step 1010, the second air-fuel ratio correction amount FAF2 is made $FAF2_2$. Then, the second air-fuel ratio correction amount FAF2 is changed by step 1011. The details of step 1011 also are illustrated in FIG. 11. Therefore, the amount FAF2 is calculated so that the mean air-fuel ratio downstream of the catalyst converter 12 is a stoichiometric air-fuel ratio corresponding to the reference voltage $V_{R2}$ (=0.5V). Then, at step 1012, the amount $FAF2_2$ for the medium region is made FAF2.

Steps 1013 to 1016 are now explained. At step 1013, the reference voltage $V_{R2}$ is made 0.8V, which corresponds to a rich air-fuel ratio as illustrated in FIG. 7. At step 1014, the second air-fuel ratio correction amount FAF2 is made $FAF2_3$. Then, the second air-fuel ratio correction amount FAF2 is changed by step 1015. The details of step 1015 also are illustrated in FIG. 11. Therefore, the amount FAF2 is calculated so that the mean air-fuel ratio downstream of the catalyst converter 12 is a rich air-fuel ratio corresponding to the reference voltage $V_{R2}$ (=0.8V). Then, at step 1016, the amount $FAF2_3$ for the high region is made FAF2.

Then, the routine of FIG. 10 is completed by step 1018.

Note that, the number of regions determined by the intake air amount Q can be a number other than 3, and the magnitudes of the regions can be equal or in equal. Also, the renewal speeds RS2 and KI2 can be changed for each region, to improve the control.

A double $O_2$ sensor system, in which an air-fuel ratio feedback control parameter of the first air-fuel ratio feedback control by the upstream-side $O_2$ sensor is variable, will be explained with reference to FIGS. 12 and 13. In this case, the skip amounts RSR and RS1, as the air-fuel ratio feedback control parameters are variable.

FIG. 12 is a routine for calculating the skip amounts RSR and RSL in accordance with the output of the downstream-side $O_2$ sensor 15 executed at every predetermined time period such as 1 s.

Steps 1201 through 1216 are the same as steps 501 through 516 of FIG. 5. That is, if one or more of the feedback control conditions is not satisfied, the control proceeds directly to step 1230 and 1231, thereby carrying out an open-loop control operation. Also, even when all of the feedback conditions are satisfied, unless the intake air amount Q is stable (steps 1206 to 1210), the control also proceeds to steps 1230 and 1231. That is, at step 1230, the rich skip amount RSR is calculated from a one-dimensional map stored in the ROM 104 by using the intake air amount Q. Also, at step 1231, the lean skip amount RSL is calculated from a one-dimensional map stored in the ROM 104 by using the intake air amount Q. Note that, in this case, the amounts RSR and RSL or the mean values $\overline{RSR}$ and $\overline{RSL}$ thereof are stored in the backup RAM 106, and in an open-loop control operation, the values RSR and RSL or $\overline{RSR}$ and $\overline{RSL}$ are read out of the backup RAM 106.

At step 1217, it is determined whether or not the second air-fuel ratio F2 is "0". If F2="0", which means that the air-fuel ratio downstream of the catalyst converter 12 is lean, the control proceeds to steps 1218 through 1223, and if F2="1", which means that the air-fuel ratio is rich, the control proceeds to steps 1224 through 1229.

At step 1218, the rich skip amount RSR is increased by a definite value ΔRS which is, for example, 0.08%, to move the air-fuel ratio to the rich side. At steps 1219 and 1220, the rich skip amount RSR is guarded by a maximum value MAX which is, for example, 7.5%.

At step 1221, the lean skip amount RSL is decreased by the definite value ΔRS to move the air-fuel ratio to the rich side. At steps 1222 and 1223, the lean skip amount RSL is guarded by a minimum value MIN which is, for example, 2.5%.

On the other hand, if F2="1" (rich), at step 1224, the rich skip amount RSR is decreased by the definite value ΔRS to move the air-fuel ratio to the lean side. At steps 1225 and 1226, the rich skip amount RSR is guarded by the minimum value MIN. Further, at step 1227, the lean skip amount RSL is decreased by the definite value ΔRS to move the air-fuel ratio to the rich side. At steps 1228 and 1229, the lean skip amount RSL is guarded by the maximum value MAX.

The skip amounts RSR and RSL are then stored in the backup RAM 106, thereby completing this routine of FIG. 12 at step 1232.

Thus, according to the routine of FIG. 12, when the output of the second $O_2$ sensor 15 is lean, the rich skip amount RSR is gradually increased, and the lean skip amount RSL is gradually decreased, thereby moving the air-fuel ratio to the rich side. Conversely, when the output of the second $O_2$ sensor 15 is rich, the rich skip amount RSR is gradually decreased, and the lean skip amount RSL is gradually increased, thereby moving the air-fuel ratio to the lean side.

Figure 13:
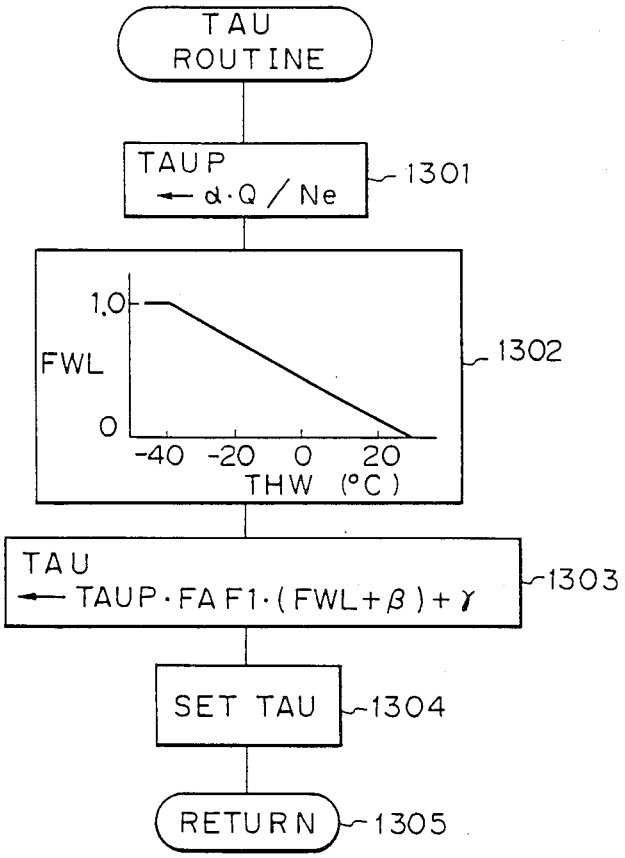

FIG. 13 is a routine for calculating a fuel injection amount TAU executed at every predetermined crank angle such as 360° CA. At step 1301, a base fuel injection amount TAUP is calculated by using the intake air amount data Q and the engine speed data Ne stored in the RAM 105. That is, $$TAUP \leftarrow \alpha \cdot Q/Ne$$

where $\alpha$ is a constant. Then at step 1302, a warming-up incremental amount FWL is calculated from a one-dimensional map by using the coolant temperature data THW stored in the RAM 105. Note that the warming-up incremental amount FWL is decreased when the coolant temperature THW is increased. At step 1303, a final fuel injectional amount TAU is calculated by $$TAU \leftarrow TAUP.FAF1.(FWL+\beta)+\gamma$$

where $\beta$ and $\gamma$ are correction factors determined by other parameters such as the voltage of the battery and the temperature of the intake air. At step 1304, the final fuel injection amount TAU is set in the down counter 108, and in addition, the flip-flop 109 is set to initiate the activation of the fuel injection valve 7. This routine is then completed by step 1105. Note that, as explained above, when a time period corresponding to the amount TAU has passed, the flip-flop 109 is reset by the carry-out signal of the down counter 108 to stop the activation of the fuel injection valve 7.

Figure 12A:
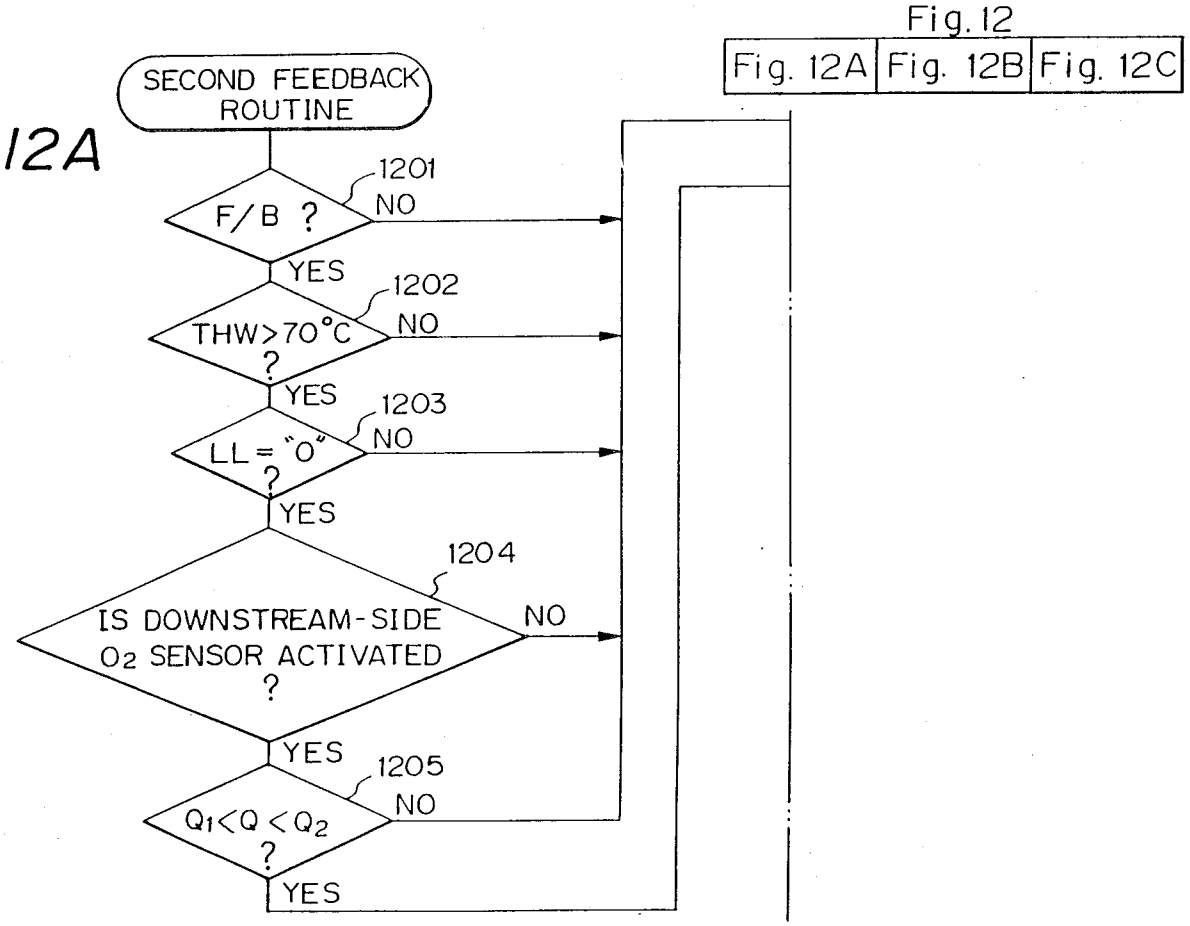
Figure 12B:
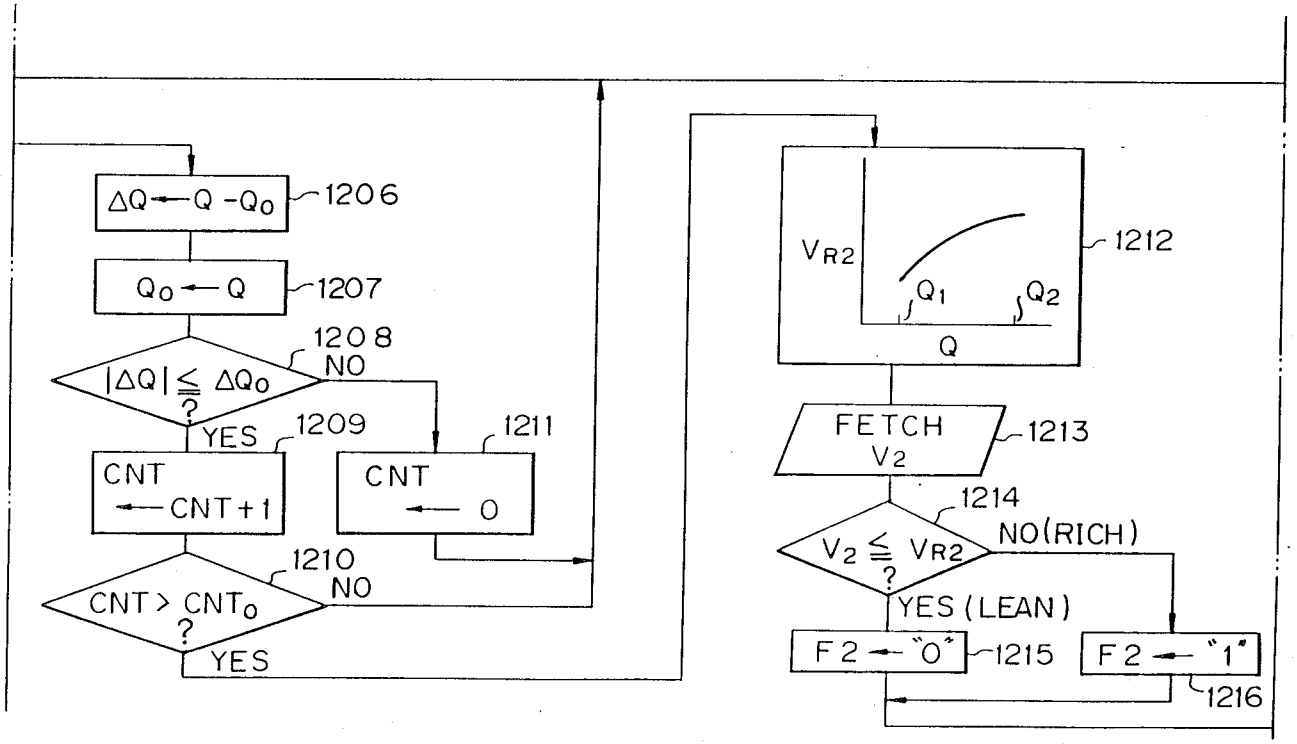
Figure 12C:
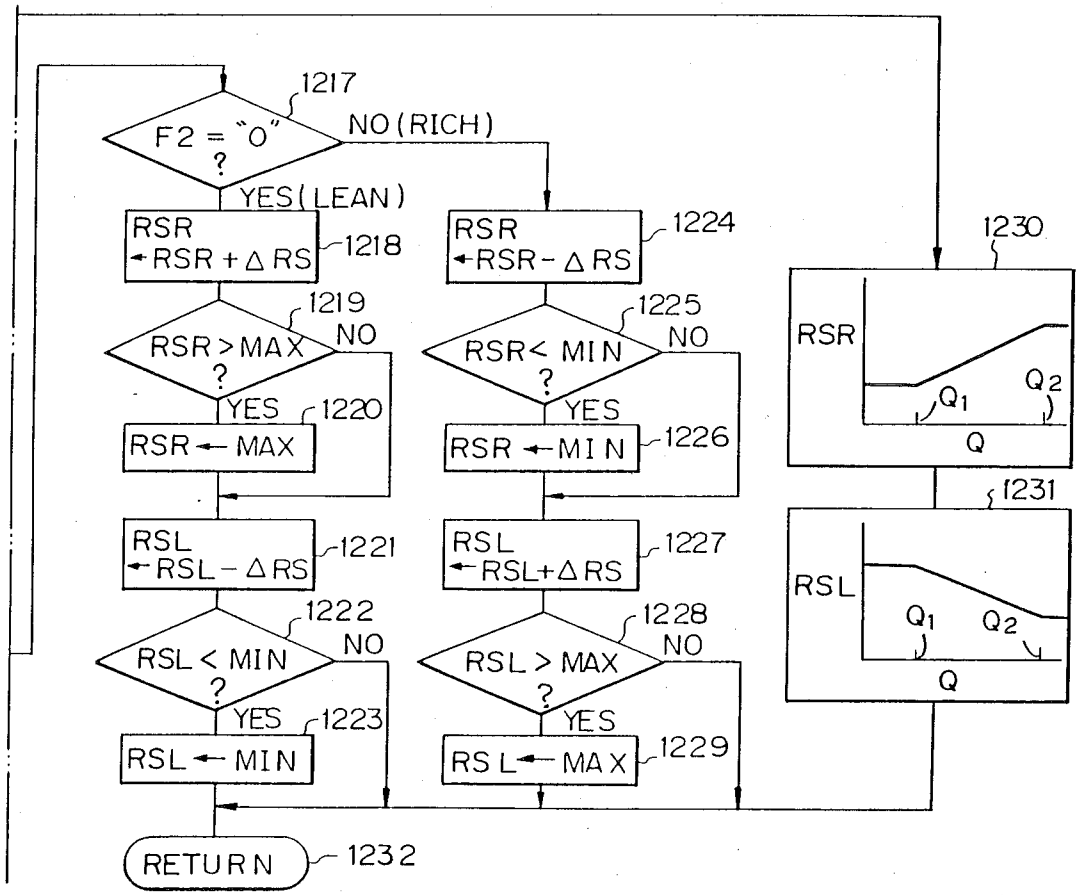
Figures 14A, 14B, 14C, 14D, 14E, 14F, 14G, 14H:
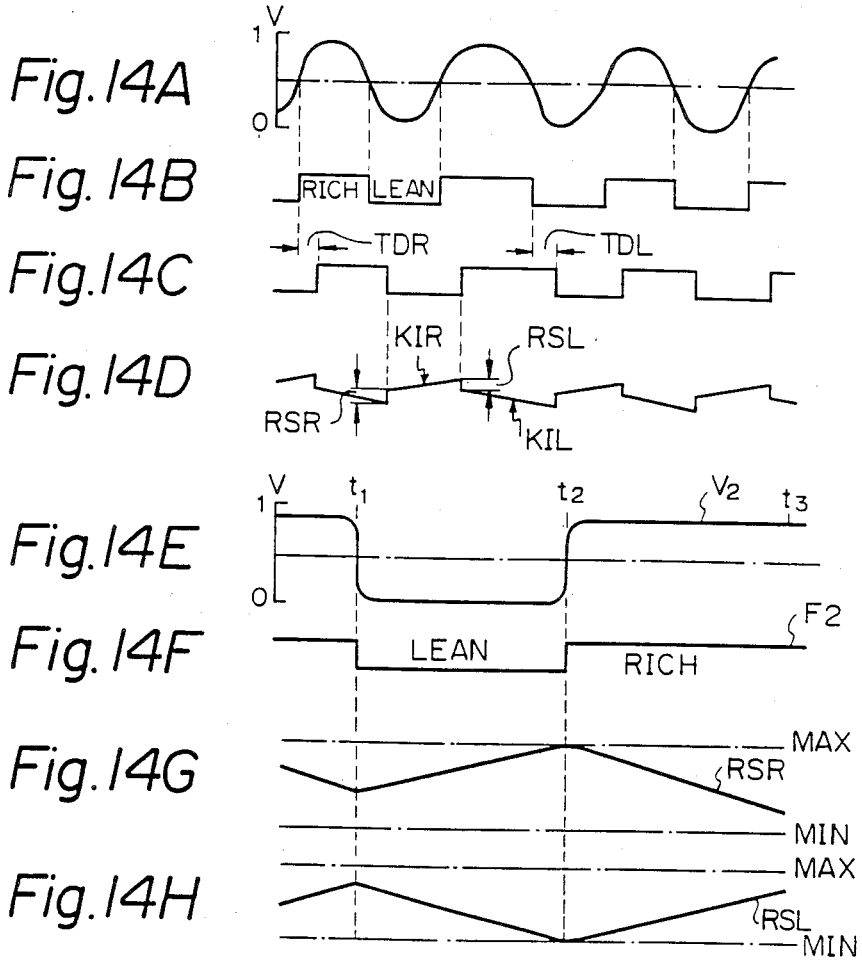
FIGS. 14A through 14H are timing diagrams explaining the flow charts of FIGS. 3, 12, and 13.

FIGS. 14A through 14H are timing diagrams for explaining the air-fuel ratio correction amount FAF1 and the skip amounts RSR and RSL obtained by the flow charts of FIGS. 3, 12 and 13. FIGS. 12A through 12F are the same as FIGS. 9A through 9F, respectively. As shown in FIGS. 14G and 14H, when the determination at step 1214 is lean, the rich skip amount RSR is increased and the lean skip amount RSL is decreased, and when the determination at step 1214 is rich, the rich skip amount RSR is decreased and the lean skip amount RSL is increased. In this case, the skip amounts RSR and RSL are changed within a range of from MAX to MIN.

In FIG. 5, which is a modification of FIG. 12, steps 1501 through 1532 are used instead of steps 1212 through 1232. Note that FIG. 15 corresponds to FIG. 10. That is, the rich skip amount RSR and the lean skip amount RSL are divided into a plurality of regions using the load parameter Q as follows:

| | |
|---|---|
| $25\ m^3/h < Q \leqq 50\ m^3/h$ | $RSR_1$, $RSL_1$ |
| $50\ m^3/h < Q \leqq 80\ m^3/h$ | $RSR_2$, $RSL_2$ |
| $80\ m^3/h < Q \leqq 120\ m^3/h$ | $RSR_3$, $RSL_3$ |

Also, the second reference voltage $V_{R2}$ is divided into a plurality of regions using the load parameter Q as follows:

| | |
|---|---|
| $25\ m^3/h < Q \leqq 50\ m^3/h$ | $V_{R2} = 0.2\ V$ |
| $50\ m^3/h < Q \leqq 80\ m^3/h$ | $V_{R2} = 0.5\ V$ |
| $80\ m^3/h < Q \leqq 120\ m^3/h$ | $V_{R2} = 0.8\ V$ |

Note that, in this case, the reference voltage $V_{R2}$ can be determined by step 512 of FIG. 5.

At steps 1501 to 1504, it is determined to what regions the intake air amount Q belongs. As a result, if $Q \leqq 25\ m^3/h$ or if $Q > 120\ m^3/h$, the control proceeds to steps 1530 and 1531 which carry out an open loop control operation. That is, the rich skip amount RSR and the lean skip amount RSL are made a definite value such as 5%. Also, in this case, the amounts RSR and RSL can be determined by steps 1330 and 1331 of FIG. 13.

On the other hand, if the intake air amount Q is in a low region ($25\ m^3/h < Q \leqq 50\ m^3/h$), the control proceeds to steps 1505 to 1512; if the intake air amount Q is in a medium region ($50\ m^3/h < Q \leqq 80\ m^3/h$), the control proceeds to steps 1513 to 1520; and if the intake air amount Q is in a high region ($80\ m^3/h < Q \leqq 120\ m^3/h$), the control proceeds to steps 1521 to 1528.

Steps 1505 to 1512 are now explained at step 1505, an A/D conversion is performed upon the output $V_2$ of the downstream-side $O_2$ sensor 15, and the A/D converted value thereof is then fetched from the A/D converter 101. At step 1506, it is determined whether or not $V_2 \leqq 0.2V$ is satisfied. Note that the reference voltage 0.2V shows a lean air-fuel ratio. As a result, if $V_2 \leqq 0.2V$, which means that the air-fuel ratio downstream of the catalyst converter 12 is lean with respect to the lean air-fuel ratio, the control proceeds to step 1507 and 1506, and if $V_2 > 0.2V$, which means that the air-fuel ratio is rich with respect to the lean air-fuel ratio, the control proceeds to steps 1509 and 1510. At step 1507, the rich skip amount $RSR_l$ is increased by a definite value ΔRSR to move the air-fuel ratio to the rich side. At step 1508, the lean skip amount $RSL_1$ is decreased by a definite value ΔRSL definite to move the air-fuel ratio to the rich side. On the other hand, if $V_2 > 0.2V$ (rich), at step 1509, the rich skip amount $RSR_1$ is decreased by the definite value ΔRSR to move the air-fuel ratio to the lean side. Further, at step 1510, the lean skip amount $RSL_1$ is decreased by the definite value ΔRSL to move the air-fuel ratio to the rich side. Then, at steps 1511 and 1512, $$RSR \leftarrow RSR_1$$

$$RSL \leftarrow RSL_1.$$

Steps 1513 to 1520 are now explained. At step 1513, an A/D conversion is performed upon the output $V_2$ of the downstream-side $O_2$ sensor 15, and the A/D converted value thereof is then fetched from the A/D converter 101. At step 1514, it is determined whether or not $V_2 \leqq 0.5V$ is satisfied. Note that the reference voltage 0.5V shows the stoichiometric air-fuel ratio. As a result, if $V_2 \leqq 0.5V$, which means that the air-fuel ratio downstream of the catalyst converter 12 is lean with respect to the stoichiometric air-fuel ratio, the control proceeds to steps 1515 and 1516, and if $V_2 \leqq 0.5V$, which means that the air-fuel ratio is rich with respect to the stoichiometric air-fuel ratio, the control proceeds to steps 1517 and 1518. At step 1515, the rich skip amount $RSR_2$ is increased by a definite value ΔRSR to move the air-fuel ratio to the rich side. At step 1516, the lean skip amount $RSL_2$ is decreased by the definite value ΔRSL to move the air-fuel ratio to the rich side. On the other hand, if $V_2 > 0.2V$ (rich), at step 1517, the rich skip amount $RSR_2$ is decreased by the definite value ΔRSR to move the air-fuel ratio to the lean side. Further, at step 1518, the lean skip amount $RSL_2$ is decreased by the definite value ΔRSL to move the air-fuel ratio to the rich side. Then, at steps 1519 and 1520, $$RSR \leftarrow RSR_2$$

$$RSL \leftarrow RSL_2.$$

Steps 1521 to 1528 are now explained. At step 1521, an A/D conversion is performed upon the output $V_2$ of the downstream-side $O_2$ sensor 15, and the A/D converted value thereof is then fetched from the A/D converter 101. At step 1522, it is determined whether or not $V_2 \leqq 0.8V$ is satisfied. Note that the reference voltage 0.8V shows a rich air-fuel ratio. As a result, if $V_2 \leqq 0.2V$, which means that the air-fuel ratio downstream of the catalyst converter 12 is lean with respect to the rich air-fuel ratio, the control proceeds to steps 1526 and 524, and if $V_2 > 0.8V$, which means that the air-fuel ratio is rich with respect to the rich air-fuel ratio, the control proceeds to steps 1525 and 1526. At step 523, the rich skip amount $RSR_3$ is increased by a definite value ΔRSR to move the air-fuel ratio to the rich side. At step 1524, the lean skip amount RSL is decreased by the definite value ΔRSL to move the air-fuel ratio to the rich side. On the other hand, if $V_2 > 0.8V$ (rich), at step 1525, the rich skip amount RSR is decreased by the definite value ΔRSR to move the air-fuel ratio to the lean side. Further, at step 1526, the lean skip amount RSL is decreased by the definite value ΔRSL to move the air-fuel ratio to the rich side. Then, at steps 1527 and 1528, $$RSR \leftarrow RSR_3$$

$$RSL \leftarrow RSL_3,$$

Then, at step 1529, the skip amounts RSR and RSL are guarded by a minimum value such as 2.5% and a maximum value such as 7.5%. Note that the minimum value MIN is a level at which the transient characteristics of the skip operation using the amounts RSR and RSL can be maintained, and the maximum value MAX is a level at which the drivability is not deteriorated by the fluctuation of the air-fuel ratio.

Figures 15, 15A:
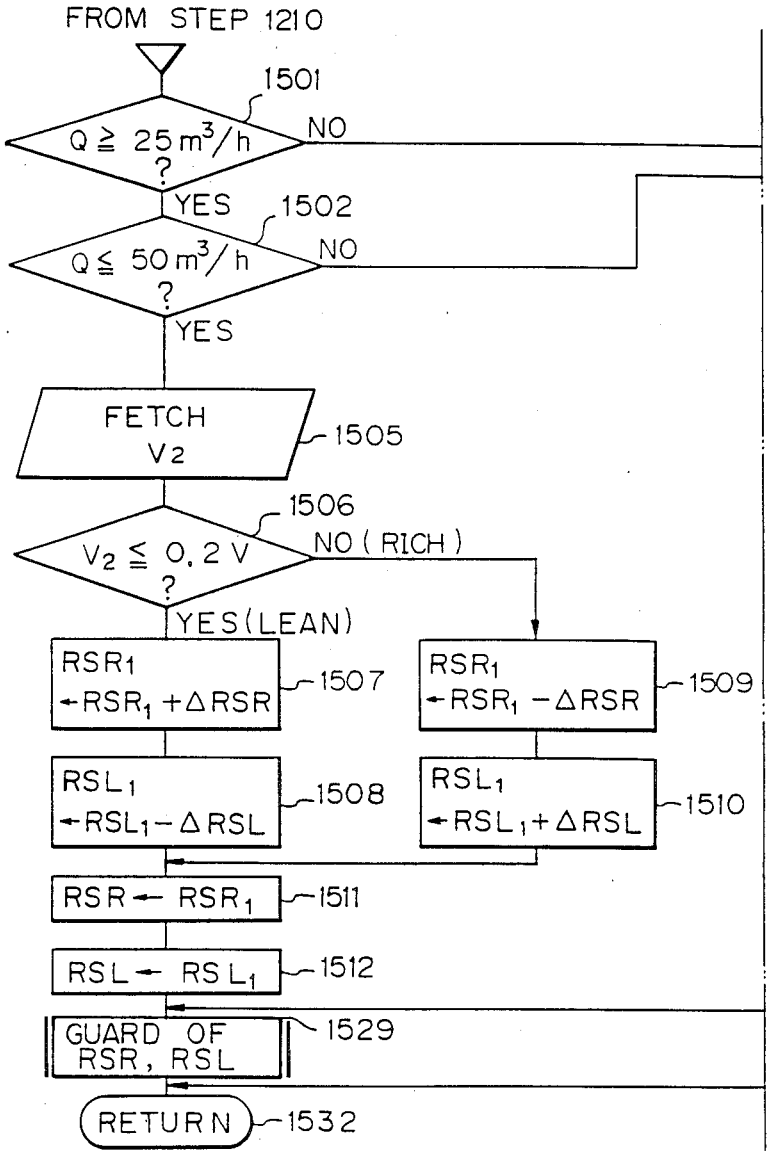
Figure 15B:
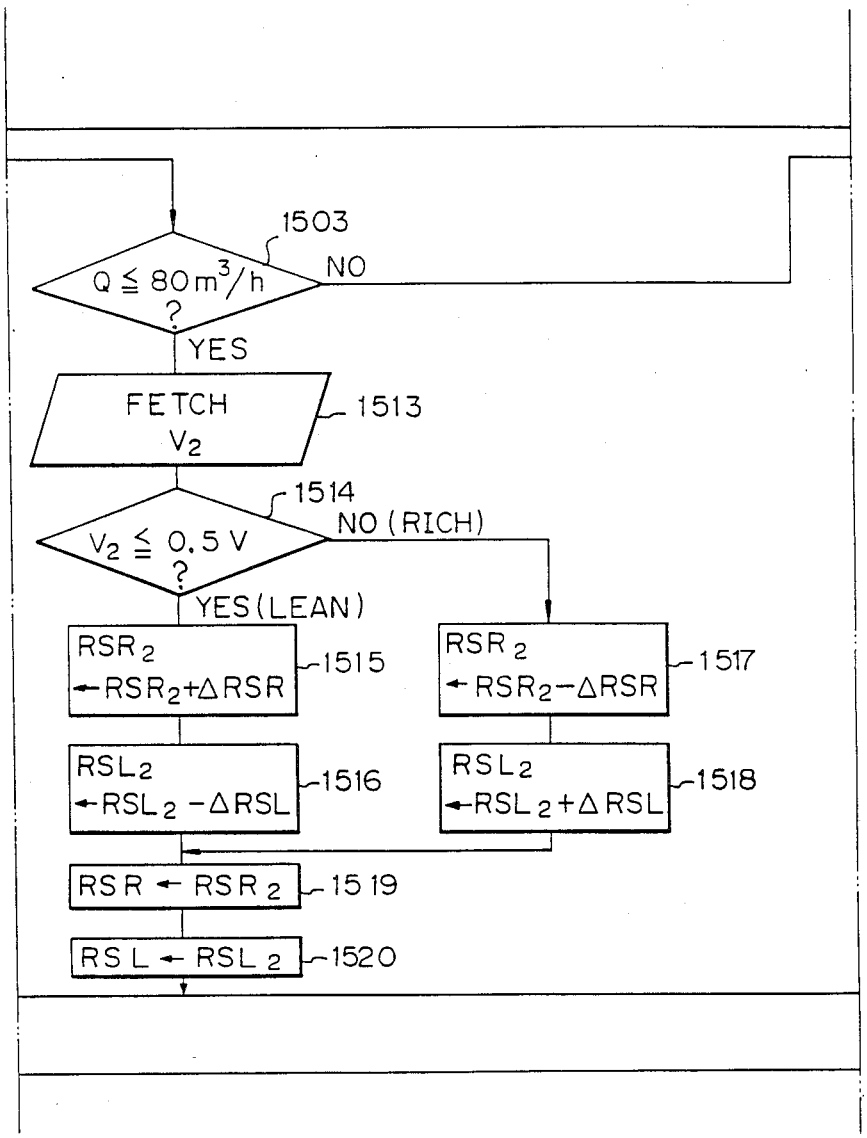
Figure 15C:
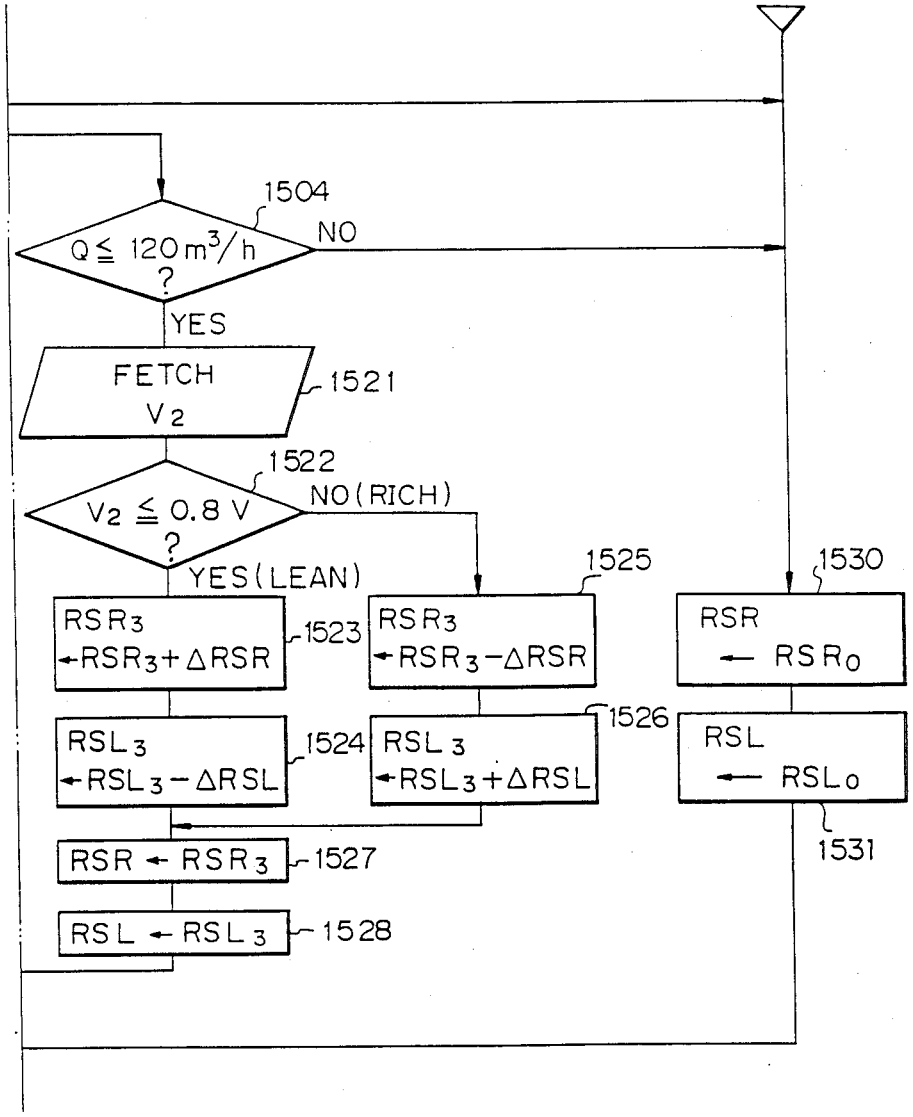

Then, the skip amounts RSR and RSL are stored in the RAM 105, thus completing the routine of FIG. 15 at step 1532.

According to the routine of FIG. 15, the skip amounts $RSR_i$ and $RSL_i$ (i=1 to 3) are provided for each region determined by a load parameter such as the intake air amount Q. Therefore, when the engine transfers from one intake air amount region to another intake air amount region, the skip amounts $RSR_i$ and $RSL_i$ suitable for this another intake air amount region are used as the current skip amounts RSR and RSL, thus obtaining required skip amounts.

Note that, the number of regions determined by the intake air amount Q can be a number other than 3, and the magnitudes of the regions can be equal or unequal. Also, the renewal speeds ΔRSR and ΔRSL can be changed for each region, to improve the control. For example, ΔRSR at step 1507 and 1509 is replaced by ΔRSR1 and ΔRSL at steps 1508, and 1510 is replaced by ΔRSL1; ΔRSR at step 1515 and 1517 is replaced by ΔRSR2 and ΔRSL at steps 1516 and 1518 is replaced by ΔRSL2; ΔRSR at steps 1523 and 1524 is replaced by ΔRSR and ΔRSL at steps 1524 and 1526 is replaced by ΔRSL3, then $$\Delta RSR1 < \Delta RSR2 < \Delta RSR3$$

$$\Delta RSL1 > \Delta RSL2 < \Delta RSL3.$$

Thus, the reference voltage $V_{R2}$ is changed in accordance with the intake air amount Q, and therefore, the mean air-fuel ratio downstream of the catalyst converter 12 is changed in accordance with the intake air amount Q. Also, the second air-fuel ratio correction amount $FAF2_i$ or the skip amounts $RSR_i$ and $RSL_i$ are calculated for each region, and as a result, the mean air-fuel ratio corresponding to the current intake air amount Q is rapidly obtained.

Figure 16:
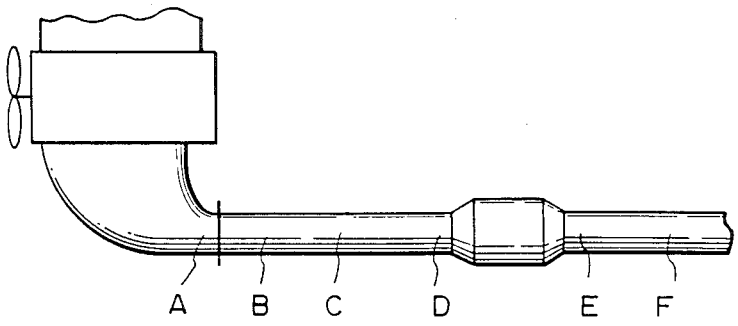
FIG. 16 is a schematic view of an arrangement of an $O_2$ sensor in an engine.
Figure 17:
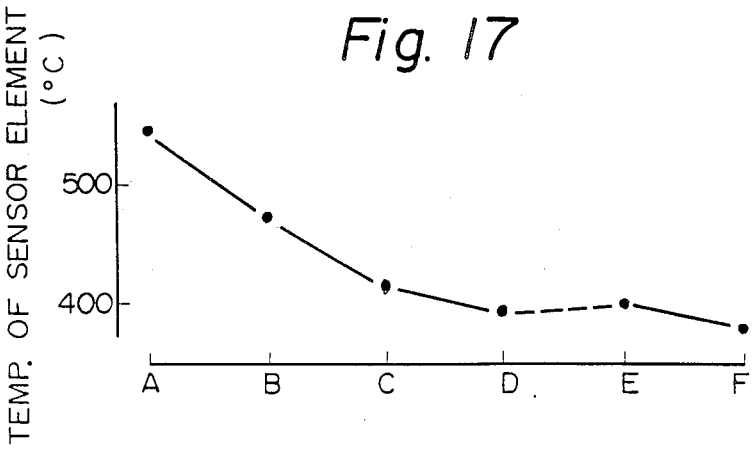
FIG. 17 is a graph showing the temperature of a sensor element in the arrangement of FIG. 16.
Figure 18:
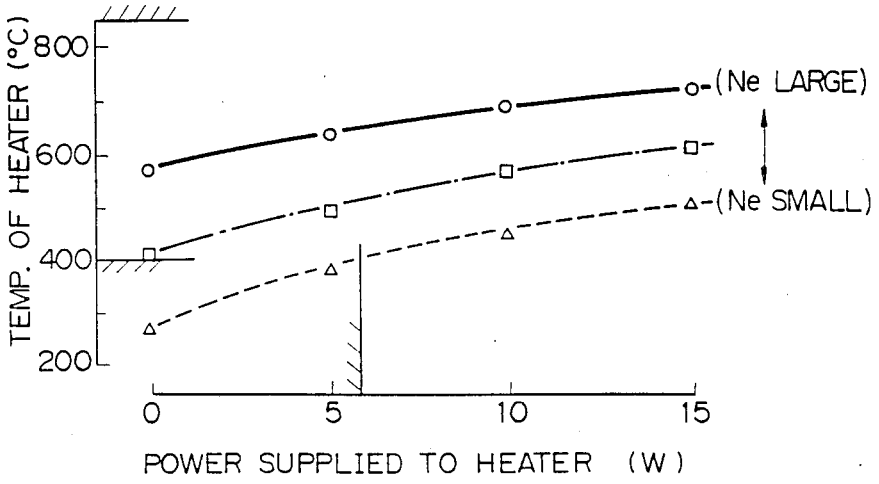
FIG. 18 is a graph showing the relationship between the power supplied to the heater and the temperature of the sensor element.
Figure 19:
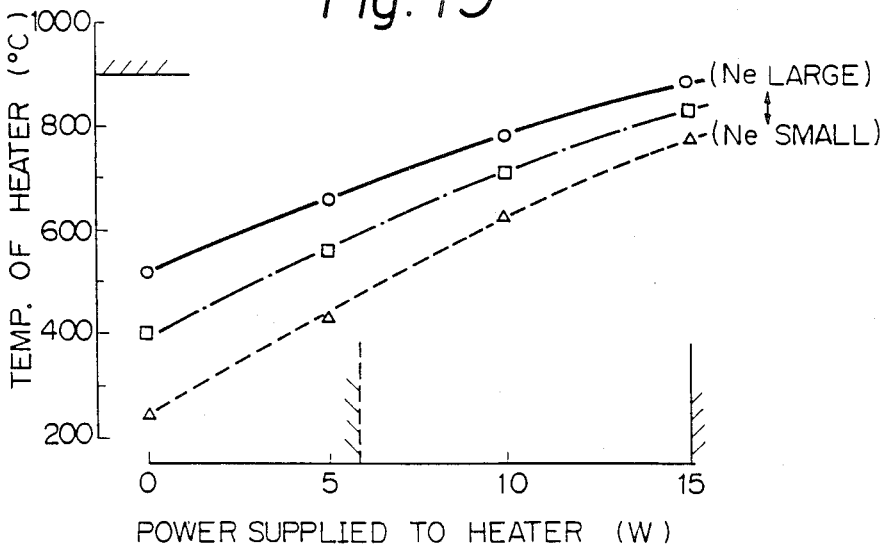
FIG. 19 is a graph showing the relationship between the power supplied to the heater and the heater temperature.

In order to obtain an accurate air-fuel ratio, the temperature of the element of the $O_2$ sensor is preferably higher than 350° to 400° C. As illustrated in FIGS. 16 and 17, the farther upstream the $O_2$ sensor is located, the higher the temperature of the element thereof. However, if the upstream-side $O_2$ sensor 13 is located farther upstream of the catalyst converter 12, the duration thereof is reduced in a high speed and high load region. On the other hand, if the downstream-side $O_2$ sensor 15 is located farther downstream of the catalyst converter 12, the temperature of the element thereof is too low and, in addition, the $O_2$ sensor may be damaged by water or foreign-objects such as stones from the exterior. Therefore, although the $O_2$ sensors 13 and 15 are located appropriately upstream and downstream of the catalyst converter 12, it is preferable to heat the $O_2$ sensors 13 and 15 at a desired temperature by the heaters 13*a* and 15*a* incorporated therein. Also, since the capacity of the heaters 13*a* and 15*a* is affected by the temperature of the exhaust gas exposed to the $O_2$ sensors, the capacity of the heater 13*a* is different from that of the heater 15*a*. Further, the relationship between the power supplied to the heater and the temperature of the element of the $O_2$ sensor is illustrated in FIG. 18, and the relationship between the power supplied to the heater and the temperature of the heater is illustrated in FIG. 19. That is, these relationships are dependent upon the engine speed Ne (or the load of the engine). Therefore, in the present invention, the heaters 13a and 15a are controlled in accordance with a parameter of the load of the engine, such as the intake air amount Q.

The control of the heaters 13a and 15a will be explained with reference to FIGS. 20 and 21.

Figure 20:
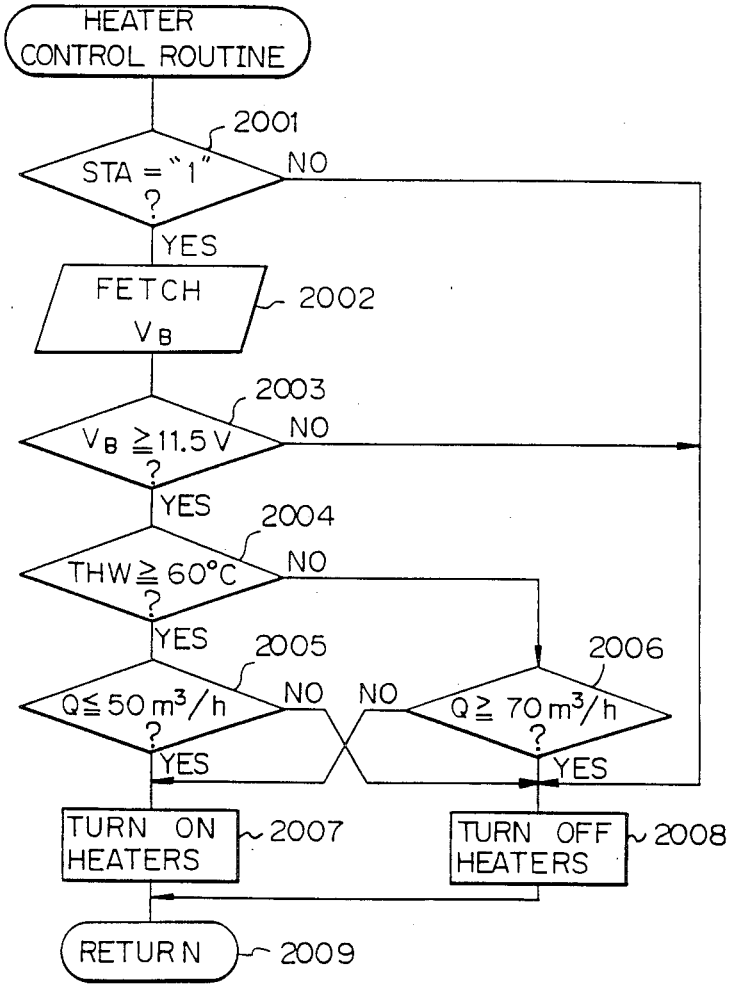

FIG. 20 is a heater controlling routine executed at a predetermined time period. At step 2001, it is determined whether or not the starter switch 18 is turned ON (STA="1"). As a result, in an engine starting state (STA="1"), the control proceeds to step 2008 which turns OFF the heaters 13a and 15a. That is, in this case, since a fuel increment for starting the engine is carried out regardless of the outputs of the $O_2$ sensors 13 and 15, the control of the heaters 13a and 15a is prohibited. Also, at step 2002, an A/D conversion is performed upon the voltage $V_B$ of the battery, and the A/D converted voltage is fetched from the A/D converter 101. Then, at step 2003, it is determined whether or not $V_B<11.5V$ is satisfied. As a result, if $V_B<11.5V$, the control also proceeds to step 2008 which turns OFF the heaters 13a and 15a. That is, when the voltage $V_B$ of the battery is too low, the heaters 13a and 15a are turned OFF to avoid a drop in the battery voltage $V_B$.

At step 2004, the coolant temperature THW is read out of the RAM 105, and it is determined whether or not THW≧60° C. is satisfied, i.e., whether the temperature of the exhaust gas is high or low. As a result, if the temperature of the exhaust gas is high (THW≧60° C.), the switching point of the heaters 13a and 15a is Q=50 $m^3/h$, and if the temperature of the exhaust gas is low (THW>60° C.), the switching point of the heaters 13a and 15a is Q=70 $m^3/h$. That is, if THW≧60° C., the control proceeds to step 2005 which determines whether or not Q≦50 $m^3/h$ is satisfied. As a result, if Q≦50 $m^3/h$, the control proceeds to step 2007 which turns ON the heaters 13a and 15a, and if Q>50 $m^3/h$, the control proceeds to step 2007 which turns OFF the heaters 13a and 15a. Similarly, if THW<60° C., the control proceeds to step 2006 which determines whether or not Q≦70 $m^3/h$ is satisfied. As a result, if Q≦70 $m^3/h$, the control proceeds to step 2007 which turns ON the heaters 13a and 15a, and if Q>70 $m^3/h$, the control proceeds to step 2007 which turns OFF the heaters 13a and 15a.

Then, this routine of FIG. 20 is completed by step 2009.

Thus, the heaters 13a and 15a of the $O_2$ sensors 13 and 15 are simultaneously turned ON and OFF in accordance with a parameter of the load of the engine, such as the intake air amount Q.

Figure 21:
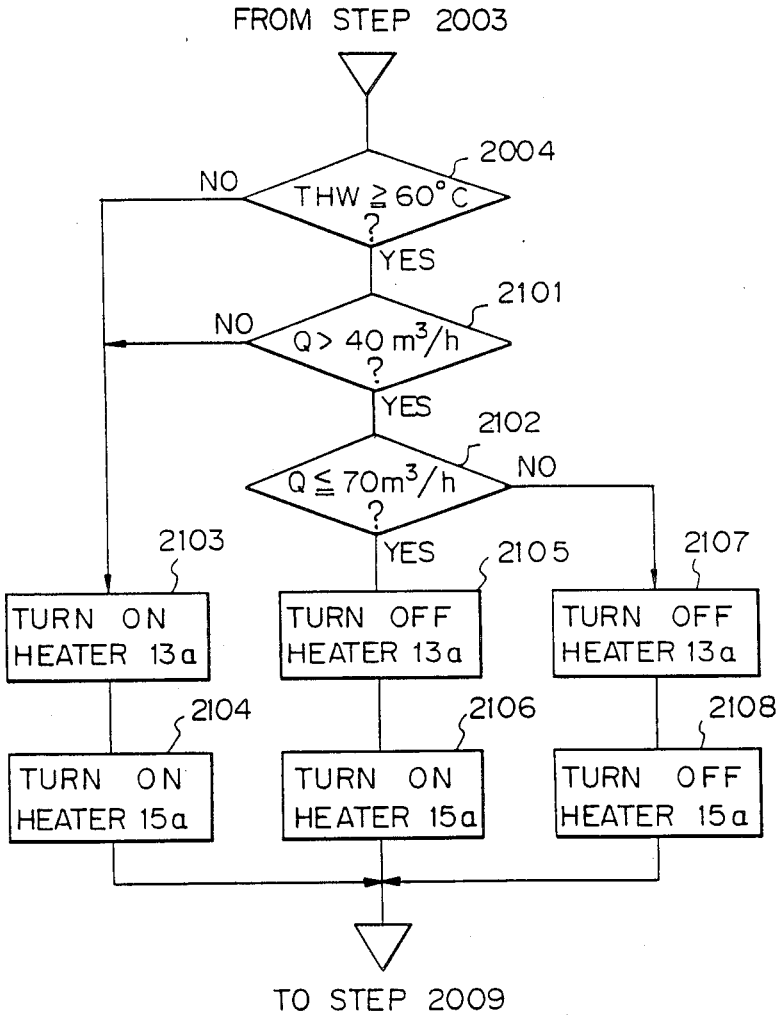

In FIG. 21, which is a modification of FIG. 20, the capacity of the heater 13a is the same as that of the heater 15a. In this case, the switching point of the heater 13a is different from that of the heater 15a, so that the power supplied to the heater 15a is larger than the power supplied to the heater 13a. That is, if THW<60° C., the heaters 13a and 15a are both turned ON, and if THW≧60° C., the heaters 13a and 15a are controlled in accordance with the intake air amount Q. That is, if Q≦40 $m^3/h$, the heaters 13a and 15a are both turned ON. Also, if 40 $m^3/h$<Q≦70 $m^3/h$, the heaters 13a and 15a are turned OFF and ON, respectively. Further, if Q>70 $m^3/h$, the heaters 13a and 15a are both turned OFF.

Thus, where the capacity of the heater 13a is the same as that of the heater 15a, they are also turned ON and OFF in accordance with the load of the engine such as the intake air amount Q. If the switching points of the heaters 13a and 15a are adjusted, the same effect as in FIG. 20 can be obtained.

Also, the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. That is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as the integration amounts KIR and KIL, the delay time periods TDR and TDL, or the reference voltage $V_{Rl}$, are variable.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 801 of FIG. 8 or at step 1301 or FIG. 13 is determined by the carburetor itself, i.e., the intake air negative pressure and the engine speed, and the air amount corresponding to TAU at step 803 of FIG. 8 or at step 1303 of FIG. 13.

Further, a CO sensor, a lean-mixture sensor or the like can be also used instead of the $O_2$ sensor.

We claim:

1. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

comparing the output of said upstream-side air-fuel ratio sensor with a first reference voltage;

detecting a load of said engine;

calculating a second reference voltage in accordance with said load of said engine;

comparing the output of said downstreamside air-fuel ratio sensor with said second reference voltage;

calculating an air-fuel ratio correction amount in accordance with the results of the comparison of the outputs of said upstream-side and downstream-side air-fuel ratio sensors; and adjusting an actual air-fuel ratio of said engine in accordance with said air-fuel ratio correction amount.

2. A method as set forth in claim 1, wherein said second reference voltage calculating step comprises the steps of:

placing said second reference voltage on the rich side when said load of said engine is large; and placing said second reference voltage on the lean side when said load of said engine is small.

3. A method as set forth in claim 1, wherein said air-fuel ratio correction amount calculating step comprises the steps of:

calculating a first air-fuel ratio correction amount in accordance with the result of the comparison of the output of said upstream-side air-fuel ratio sensor; and calculating a second air-fuel ratio correction amount allocated to a load region including the current load of said engine in accordance with the result of the comparison of the output of said downstream-side air-fuel ratio sensor, thereby calculating said air-fuel ratio correction amount in accordance with said first and second air-fuel ratio correction amounts.

4. A method as set forth in claim 1, wherein said air-fuel ratio correction amount calculating step comprises a step of calculating an air-fuel ratio feedback control parameter allocated to a load region including the current load of said engine in accordance with the result of the comparison of the output of said downstream-side air-fuel ratio sensor, thereby calculating said air-fuel ratio correction amount in accordance with the output of said upstream-side air-fuel ratio sensor and said air-fuel ratio feedback control parameter.

5. A method as set forth in claim 4, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

6. A method as set forth in claim 4, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

7. A method as set forth in claim 4, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

8. A method as set forth in claim 4, wherein said air-fuel ratio feedback control parameter is determined by a reference voltage with which the output of said upstream-side air-fuel ratio sensor is compared, thereby determining whether the air-fuel ratio is on the rich side or on the lean side.

9. A method as set forth in claim 1, further comprising the steps of:

determining whether or not a change of said load of said engine is larger than a definite value; and prohibiting the calculation of said second reference voltage when the change of said load of said engine is larger than said definite value.

10. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for comparing the output of said upstream-side air-fuel ratio sensor with a first reference voltage;

means for detecting a load of said engine;

means for calculating a second reference voltage in accordance with said load of said engine;

means for comparing the output of said downstream-side air-fuel ratio sensor with said second reference voltage; and means for calculating an air-fuel ratio correction amount in accordance with the results of a comparison of the outputs of said upstream-side and downstream-side air-fuel ratio sensors; and means for adjusting an actual air-fuel ratio of said engine in accordance with said air-fuel ratio correction amount.

11. An apparatus as set forth in claim 10, wherein said second reference voltage calculating means comprises:

means for placing said second reference voltage on the rich side when said load of said engine is large; and means for placing said second reference voltage on the lean side when said load of said engine is small.

12. An apparatus as set forth in claim 10, wherein said air-fuel ratio correction amount calculating means comprises:

means for calculating a first air-fuel ratio correction amount in accordance with the result of the comparison of the output of said upstream-side air-fuel ratio sensor; and means for calculating a second air-fuel ratio correction amount allocated to a load region including the current load of said engine in accordance with the result of the comparison of the output of said downstream-side air-fuel ratio sensor, thereby calculating said air-fuel ratio correction amount in accordance with said first and second air-fuel ratio correction amounts.

13. An apparatus as set forth in claim 10, wherein said air-fuel ratio correction amount calculating means comprises means for calculating an air-fuel ratio feedback control parameter allocated to a load region including the current load of said engine in accordance with the result of the comparison of the output of said downstream-side air-fuel ratio sensor, thereby calculating said air-fuel ratio correction amount in accordance with the output of said upstream-side air-fuel ratio sensor and said air-fuel ratio feedback control parameter.

14. An apparatus as set forth in claim 13, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

15. An apparatus as set forth in claim 13, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

16. An apparatus as set forth in claim 13, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

17. An apparatus as set forth in claim 13, wherein said air-fuel ratio feedback control parameter is determined by a reference voltage with which the output of said upstream-side air-fuel ratio sensor is compared, thereby determining whether the air-fuel ratio is on the rich side or on the lean side.

18. An apparatus as set forth in claim 10, further comprising:

means for determining whether or not a change of said load of said engine is larger than a definite value; and means for prohibiting the calculation of said second reference voltage when the change of said load of said engine is larger than said definite value.

19. An apparatus as set forth in claim 10, further comprising means for simultaneously heating said upstream-side and downstream-side air-fuel ratio sensors in accordance with a coolant temperature of said engine and said load of said engine.

20. An apparatus as set forth in claim 10, further comprising means for separately heating said upstream-side and downstream-side air-fuel ratio sensors in accordance with a coolant temperature of said engine and said load of said engine.

* * * * *